US007587165B2

(12) United States Patent
Takiguchi et al.

(10) Patent No.: US 7,587,165 B2
(45) Date of Patent: Sep. 8, 2009

(54) IMAGE FORMING APPARATUS

(75) Inventors: Toshiki Takiguchi, Yamatokoriyama (JP); Tatsuya Inoue, Nara (JP); Kouji Wakamoto, Nara (JP); Tsutomu Yoshimoto, Yamatotakada (JP); Syoichiro Yoshiura, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 514 days.

(21) Appl. No.: 11/354,858

(22) Filed: Feb. 16, 2006

(65) Prior Publication Data

US 2006/0182477 A1 Aug. 17, 2006

(30) Foreign Application Priority Data

Feb. 17, 2005 (JP) ..... 2005-041308

(51) Int. Cl.
*G03G 15/00* (2006.01)

(52) U.S. Cl. ..... 399/396; 399/394

(58) Field of Classification Search ..... 399/396, 399/394

See application file for complete search history.

(56) References Cited

U.S. PATENT DOCUMENTS 6,263,186 B1 * 7/2001 Okamoto et al. ..... 399/388
6,374,076 B1 * 4/2002 Tanaka ..... 399/396
6,813,471 B2 * 11/2004 Sawai et al. ..... 399/388
2003/0113150 A1 * 6/2003 Fujita ..... 399/394
2004/0165915 A1 * 8/2004 Hirai et al. ..... 399/302
2004/0170457 A1 * 9/2004 Kamimura et al. ..... 399/388

FOREIGN PATENT DOCUMENTS

JP 3-101769 A 4/1991
JP 9-68874 A 3/1997
JP 2003-149960 A 5/2003
JP 2004-149265 A 5/2004

* cited by examiner

*Primary Examiner*—Anthony H. Nguyen
(74) *Attorney, Agent, or Firm*—Birch, Stewart, Kolasch & Birch, LLP

(57) ABSTRACT

An image forming apparatus carries out an image processing with respect to a sheet size and image information based on a print request to obtain a write image on a photoreceptor. On the basis of a printing ratio of the write image, the apparatus predicts occurrence of an image elongation. If the apparatus predicts that the image elongation occurs, the apparatus calculates a bending amount of a bended portion based on the difference between peripheral velocities of a photoreceptor and the idle roller, and the apparatus variably controls the peripheral velocity of an idle roller so that the bending amount is adjusted so as not to cause a slip phenomenon. It is possible to avoid the occurrence of a phenomenon of slipping of a sheet with respect to the photoreceptor without lowering image quality, and to surely secure a blank space formed at a rear edge portion of the sheet.

11 Claims, 12 Drawing Sheets

IMAGE FORMING APPARATUS

This Nonprovisional application claims priority under 35 U.S.C. §119(a) on Patent Application No. 41308/2005 filed in Japan on Feb. 17, 2005, the entire contents of which are hereby incorporated by reference.

BACKGROUND OF THE INVENTION

1. Field of the Invention

The present invention relates to an image forming apparatus which visualizes an electrostatic latent image formed on an electrostatic latent image bearing member, so as to form a visible image, and then transfers the visible image to a recording material while conveying the recording material.

2. Description of the Related Art

An image forming apparatus causes a writing device to form on a photoreceptor (electrostatic latent image bearing member) an electrostatic latent image based on image information, and visualizes the electrostatic latent image with a toner (developer) so as to form a toner image (visible image). Then, a transfer device transfers the toner image from the photoreceptor to a sheet that is a recording material.

In the case in which the transfer device is a transfer roller, the toner image is transferred to the sheet by (i) supplying the sheet to a transfer nip portion where the photoreceptor and the transfer roller are compressed against each other, and (ii) conveying the sheet (recording material) by rotational forces of the photoreceptor and the transfer roller. Because a transfer voltage is applied to the transfer roller, the sheet passing through the transfer nip portion is electrically charged by the transfer voltage. Therefore, the toner on the photoreceptor is absorbed by the sheet.

Incidentally, a peripheral velocity of the transfer roller is higher than that of the photoreceptor. Therefore, the sheet once sticks to the photoreceptor, but is pulled due to the difference in peripheral velocity between the photoreceptor and the transfer roller. Thus, the sheet is separated from the photoreceptor. This arrangement is made to avoid deterioration in printing quality, such as hollow characters and halftone thin dots caused due to a separation discharge generated when the sheet is separated from the transfer nip portion.

That is, the transfer voltage is applied to the transfer roller to transfer the toner to the sheet, however it is no exaggeration to say that a portion where the transfer voltage works normally is the transfer nip portion. Therefore, a white portion (that is, a portion on which the toner is not deposited) on the surface (close to the photoreceptor) of the sheet at the transfer nip portion is electrically charged with a high potential. On this account, when the sheet is separated from the transfer nip portion, the separation discharge is generated between the white portion of the sheet and a high potential portion on the photoreceptor. Due to the separation discharge, some of the toner transferred to the sheet is reversely transferred to the photoreceptor. This causes the above-described deterioration in printing quality.

In front of the transfer nip portion, a sheet conveying roller, called an idle roller, is provided. The sheet conveying roller rotates at substantially the same peripheral velocity as the transfer roller. The idle roller rotates intermittently so that the sheet and the toner image on the photoreceptor are aligned with each other. The idle roller once stops rotating when the sheet has reached the idle roller, and then restarts rotating at such a timing that the toner image on the photoreceptor passes through the transfer nip portion. In this way, the idle roller conveys the sheet to the transfer nip.

As shown in FIGS. 12(*a*) to 12(*d*), a sheet P conveyed by an idle roller 116 is conveyed to a contact point of a transfer nip portion 127 in such a direction that the front edge of the sheet P proceeds toward an outer circumference of the photoreceptor 121. After the front edge of the sheet P first contacts with the photoreceptor 121, the sheet P is conveyed to the transfer nip portion 127 by the rotation of the photoreceptor 121.

If the front edge of the sheet P directly contacts with the contact point of the transfer nip portion 127, the sheet P vibrates at the moment of the front edge of the sheet P entering the transfer nip portion 127. This vibration may cause a print slur (image deviation, transfer deviation) and/or a paper cockle at the front edge of the sheet P.

Further, in front of the transfer nip portion 127, a bended portion 128 of the sheet P is formed as shown in FIG. 12(*d*). This bending is formed under such a condition that the peripheral velocity of the idle roller 116 is substantially equal to the peripheral velocity of a transfer roller 125 and the peripheral velocity of the photoreceptor 121 is a bit lower than each of the peripheral velocity of the idle roller 116 and the peripheral velocity of the transfer roller 125. By forming the bended portion (bending) 128 in front of the transfer nip portion 127, the sheet P is conveyed to the transfer nip portion 127 in a state in which the sheet P surely sticks to the surface of the photoreceptor 121. Therefore, it is possible to prevent the problem in which, before the sheet P reaches the transfer nip portion 127, the sheet P sticks to the surface of the transfer roller 125 so as to be charged unnecessarily. Excessive charge to the sheet causes the above-described phenomenon of reversely transferring the toner.

By the bended portion 128 which intends to be flat, the sheet P is pushed in a direction in which the sheet P is conveyed. Moreover, the longer the length of the sheet P in the direction in which the sheet P is conveyed becomes, the larger the amount (bending amount) of the bended portion 128 of the sheet P becomes. However, the bending amount is usually set so that slipping of the sheet P is avoided by a nip pressure of the transfer nip portion 127.

Regarding the sheet conveying roller provided in front of the transfer nip portion, Japanese Unexamined Patent Publication No. 149265/2004 (Tokukai 2004-149265, published on May 27, 2004) discloses an image forming device capable of maintaining a certain speed difference between the running speed of a transcription belt and the speed of conveyance of a recording sheet conveyed by a resist roller corresponding to the sheet conveying roller, the speed difference being maintained irrespective of a change with time etc. of the performance of the resist roller.

According to this, the image forming device is structured so that the recording sheet conveyed by the resist roller is conveyed to image carriers for different colors by the transcription belt and the toner images on the image carriers are transcribed on the recording sheet, and the rotating speed of a resist motor is controlled so that the moving time of the recording sheet leading edge from one sensor to another installed between the resist roller and a suction roller and the moving time of the recording sheet trailing edge become predetermined values.

Moreover, in recent years, a particle diameter of the toner for visualizing the electrostatic latent image has been reduced due to an increase in resolution of the image information. Conventionally, the particle diameter of the toner is substantially in a range from 8 Φμm to 12 Φμm. However, in recent years, the particle diameter of the toner is substantially in a range from 4 Φμm to 7 Φμm. In the case of a small-particle toner used in recent years, even if large particles and fine particles are removed in a manufacturing step, crushing occurs due to friction at the time of frictional electrification that is the application of electric charge to the toner. Therefore, the toner whose particle diameter is 2 Φμm or less also contributes to an image development.

Conventionally, the image forming apparatus forcibly omits a signal corresponding to a sheet peripheral edge portion determined by the image forming apparatus, from an image signal supplied from a terminal device such as a host computer, so as to form a blank space.

If the above omission is not carried out in the case of recording on the entire sheet the image based on the image signal supplied from the terminal device, the toner corresponding to the sheet peripheral edge portion of the toner image on the photoreceptor is not transferred, and the toner remains on the photoreceptor. Then, the remaining toner scatters inside the image forming apparatus. This causes deterioration in image quality and/or a jam.

With regard to such a technique for forcibly forming the blank space, for example, Japanese Unexamined Patent Publication No. 101769/1991 (Tokukaihei 3-101769, published on Apr. 26, 1991) discloses a technique for separately changing the size of each blank space corresponding to each edge of a sheet when images are formed on the same sheet twice. Even if an error in a tolerance range occurs, an image can be prevented from sticking out, and it is possible to increase a region which can be utilized effectively for image formation.

Moreover, Japanese Unexamined Patent Publication No. 068874/1997 (Tokukaihei 9-068874, published on Mar. 11, 1997) discloses a technique in which, after a first test pattern (a solid image having a small blank space at a rear edge) is outputted and an image whose rear edge portion is blurred is obtained, a second test pattern having a normal blank space at a rear edge is outputted and the blank space at the rear edge is adjusted so as to correct the blur at the rear edge portion of the image. With this, it is possible to prevent the damage caused by the transfer charge (transfer electric field) to the image carrier (photoreceptor), and also possible to obtain the image of high quality.

However, since the particle diameter of the toner has been reduced these days, there occur problems which had not occurred in the past. That is, the problem is a phenomenon in which the rear edge of the image formed on the sheet moves backward, that is, the image is lengthened on the sheet. In a terrible case, the blank space provided at the sheet rear edge portion completely disappears. This phenomenon relates to a printing ratio on the sheet, and occurs in the case in which the printing ratio is high.

As a result of studies for finding out the cause of the above-described phenomenon, the inventors of the present application found that the phenomenon is caused by a phenomenon in which the sheet slips with respect to the photoreceptor at the transfer nip portion. The present inventors further found that this slipping is caused by a combination of the following factors: (i) a decrease in particle diameter of the toner, (ii) the difference in peripheral velocity between the photoreceptor and the transfer roller and (iii) the bended portion formed in front of the transfer nip portion.

That is, in the case in which the amount of toner between the sheet and the photoreceptor is large, the absorptive power between the sheet and the photoreceptor decreases due to the decrease in particle diameter of the toner. Because of the decrease in the absorptive power, the nip pressure of the transfer nip portion cannot overcome the pushing power generated by the bended portion formed in front of the transfer nip portion. Therefore, the sheet moves in accordance with the peripheral velocity of the transfer roller. As a result, the sheet slips with respect to the photoreceptor.

The following will explain a mechanism of the decrease in the absorptive power between the sheet and the photoreceptor in reference to FIGS. 11(*a*) and 11(*b*). FIGS. 11(*a*) and 11(*b*) show the transfer nip portion where the toner image is transferred. A conventional large-particle toner T is used in FIG. 11(*a*), and a small-particle toner t of today is used in FIG. 11(*b*).

At the transfer nip portion 127, the photoreceptor 121 and the transfer roller 125 are compressed against each other via the toner (T, t) and a sheet P in this order when viewed from the photoreceptor 121, and a transfer voltage is applied by a transfer voltage applying section 129 through the transfer roller 125. The sheet P is conveyed in a sheet conveyance direction (indicated by an arrow X) by the rotational forces of the photoreceptor 121 and the transfer roller 125. Note that in FIGS. 11(*a*) and 11(*b*), an arrow Y indicates a rotation direction of the photoreceptor 121 and an arrow Z indicates a rotation direction of the transfer roller 125.

By applying the transfer electric field from the transfer roller 125 through the sheet P to the toner on the photoreceptor 121, the toner is absorbed by the sheet P. However, even in the case in which the thickness of a toner layer in FIG. 11(*a*) is the same as that in FIG. 11(*b*), an air layer in the toner layer made by the small-particle toner t is larger than an air layer in the toner layer made by the large-particle toner T.

Therefore, in the photoreceptor, the toner, the sheet and the transfer roller, the distance of propagation of the electric field is longer in the toner layer of the small-particle toner t than in the toner layer of the large-particle toner T. In the case in which the distance of propagation is long, the intensity of the electric field (electric field intensity) becomes low when the electric field propagates the toner layer and reaches the photoreceptor 121. As a result, the absorptive power between the sheet P and the photoreceptor 121 decreases.

Since the absorptive power between the sheet P and the photoreceptor decreases, the phenomenon of slipping of the sheet with respect to the photoreceptor occurs by the pushing power of the bended portion formed in front of the transfer nip portion. As a result, the phenomenon of backward movement of the rear edge of the image transferred to the sheet P occurs.

In the case in which the rear edge of the image moves backward and the blank space provided at the rear edge portion of the sheet completely disappears, there are problems in that the remaining toner on the photoreceptor causes printing stain when printing an image on the following sheet(s) and the printing quality (image quality) deteriorates because of no blank space. In addition to these, in a compact image forming apparatus which employs a switchback conveyance method and is capable of carrying out two-side printing, the sheet winds around a fixing roller and the jam occurs.

In the switchback conveyance method, a front edge and a rear edge reverse between when printing on a first surface and when printing on a second surface. That is, the rear edge portion of the first surface becomes the front edge portion of the second surface. In the case in which the blank space at the front edge portion disappears, the sheet is conveyed to a fixing process that is the next process of the transfer process and the unfixed toner is molten and fixed, the molten toner sticks to the fixing roller, the sheet winds around the fixing roller and the jam occurs.

This problem occurs since the particle diameter of the toner has been reduced. Therefore, this problem is a new problem which had not been considered in the past. Since the techniques disclosed in the above-described three Japanese Unexamined Patent Publications do not consider the problem, those techniques, of course, cannot solve the problem.

SUMMARY OF THE INVENTION

An object of the present invention is to provide an image forming apparatus which can avoid an occurrence of a phenomenon of slipping of a sheet with respect to a photoreceptor without lowering an image quality and can also secure a blank space formed at a rear edge portion of the sheet.

In order to achieve the above object, an image forming apparatus of the present invention forms on an electrostatic latent image bearing member an electrostatic latent image based on image information, visualizes the electrostatic latent image by a developer so as to obtain a visible image, and causes a transfer device to transfer the visible image to a recording material at a transfer nip portion while conveying the recording material, and the image forming apparatus includes: a recording material conveying roller which is provided in front of the transfer nip portion and rotates intermittently so that the recording material and the visible image are aligned with each other; an image elongation predicting section (image elongation predicting means) for predicting an occurrence of an image elongation, in other words, predicting that, due to slipping of the recording material with respect to the electrostatic latent image bearing member at the transfer nip portion, the visible image transferred is lengthened in a direction in which the recording material is conveyed; and a bending amount adjusting section (bending amount adjusting means) for, if the image elongation predicting section predicts that the image elongation occurs, variably controlling a peripheral velocity of the recording material conveying roller after a front edge of the recording material has reached the transfer nip portion, the peripheral velocity being variably controlled so that a bending of the recording material is reduced in size, the bending being formed between the transfer nip portion and the recording material conveying roller.

According to this, the image elongation predicting section predicts the occurrence of the image elongation, in other words, predicts that, due to the slipping of the recording material with respect to the electrostatic latent image bearing member at the transfer nip portion, the visible image transferred is lengthened in the direction in which the recording material is conveyed. If the image elongation predicting section predicts that the image elongation occurs, the bending amount adjusting section variably controls the peripheral velocity of the recording material conveying roller after the front edge of the recording material has reached the transfer nip portion, although the peripheral velocity of the recording material conveying roller is originally constant. Thus, the bending formed in front of the transfer nip portion is reduced in size.

That is, in the case in which the occurrence of a slip phenomenon is predicted, the bending of the recording material is reduced in size since the bending is one of factors for causing the slip phenomenon. This suppresses or prevents the occurrence of the slip phenomenon effectively. As a result, the blank space at the rear edge portion of the sheet is surely secured, and it is possible to appropriately avoid problems caused due to the reduction or disappearance of the blank space at the rear edge portion of the recording material. The problems are exemplified by (i) the printing stain caused by the remaining developer on the electrostatic latent image bearing member when printing an image on the following sheet(s), (ii) the deterioration in the printing quality (image quality) because of no blank space and (iii) the jam at the fixing section when carrying out the two-side printing adopting the switchback conveyance method.

In addition, in this case, the bending formed in front of the transfer nip portion does not completely disappear, but is just reduced in size so that the slip phenomenon does not occur. Therefore, it is possible to obtain an effect obtained by forming the bending, that is, an effect of avoiding a problem in which, before the recording material reaches the transfer nip portion, the recording material sticks to the transfer device so as to be charged unnecessarily.

Further, the image forming apparatus of the present invention can be so arranged as to further include an image elongation occurring area specifying section (image elongation occurring area specifying means) for specifying an image elongation occurring area of the electrostatic latent image, the image elongation occurring area being an area having such a possibility that the image elongation occurs. In addition, in the image forming apparatus of the present invention, the bending amount adjusting section variably controls the peripheral velocity of the recording material conveying roller so that the bending is small when the image elongation occurring area specified by the image elongation occurring area specifying means has reached the transfer nip portion.

According to this, the bending having an appropriate amount is secured in front of the transfer nip portion while an area not having such a possibility that the slip phenomenon occurs is passing through the transfer nip portion, but the bending is reduced in size only while the area having such a possibility that the slip phenomenon occurs is passing through the transfer nip portion. Therefore, the bending which provides the above-described effect is not reduced in size while an area which does not require the reduction in size of the bending is passing through the transfer nip portion.

Additional objects, features, and strengths of the present invention will be made clear by the description below. Further, the advantages of the present invention will be evident from the following explanation in reference to the drawings.

DETAILED DESCRIPTION OF THE INVENTION

The following will explain one embodiment of the present invention in reference to FIGS. 1 to 10. Note that the present invention is not limited to this. In the following description, a blank space provided forcibly at a peripheral edge potion of a sheet is referred to as a void. Specifically, the blank spaces provided at a rear edge portion, a front edge portion, a left edge portion and a right edge portion of a sheet P are referred to as a rear edge void, a front edge void, a left edge void and a right edge void, respectively.

Figure 2:
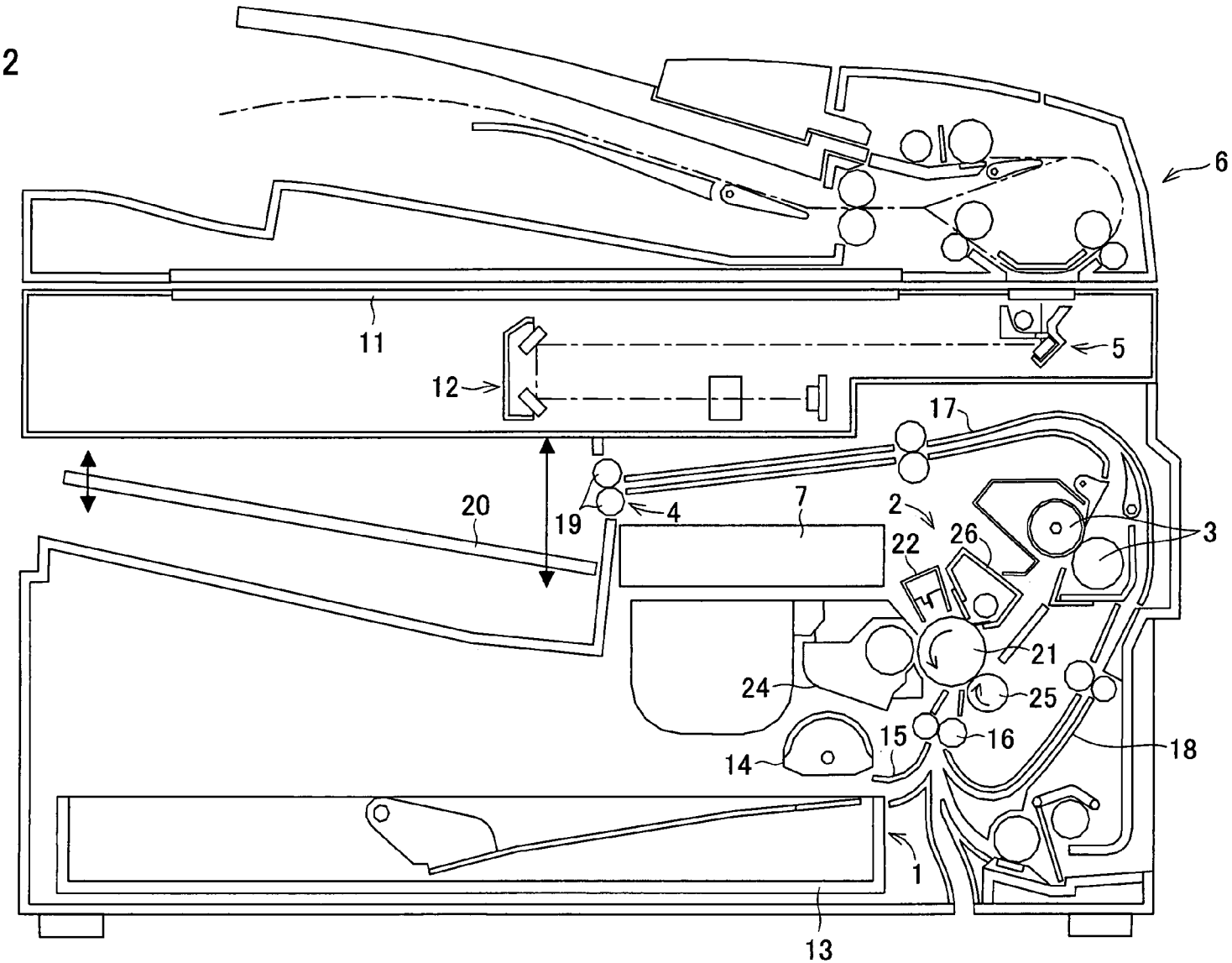
FIG. 2 is a vertical cross-sectional view showing an arrangement of the image forming apparatus.
Figure 3:
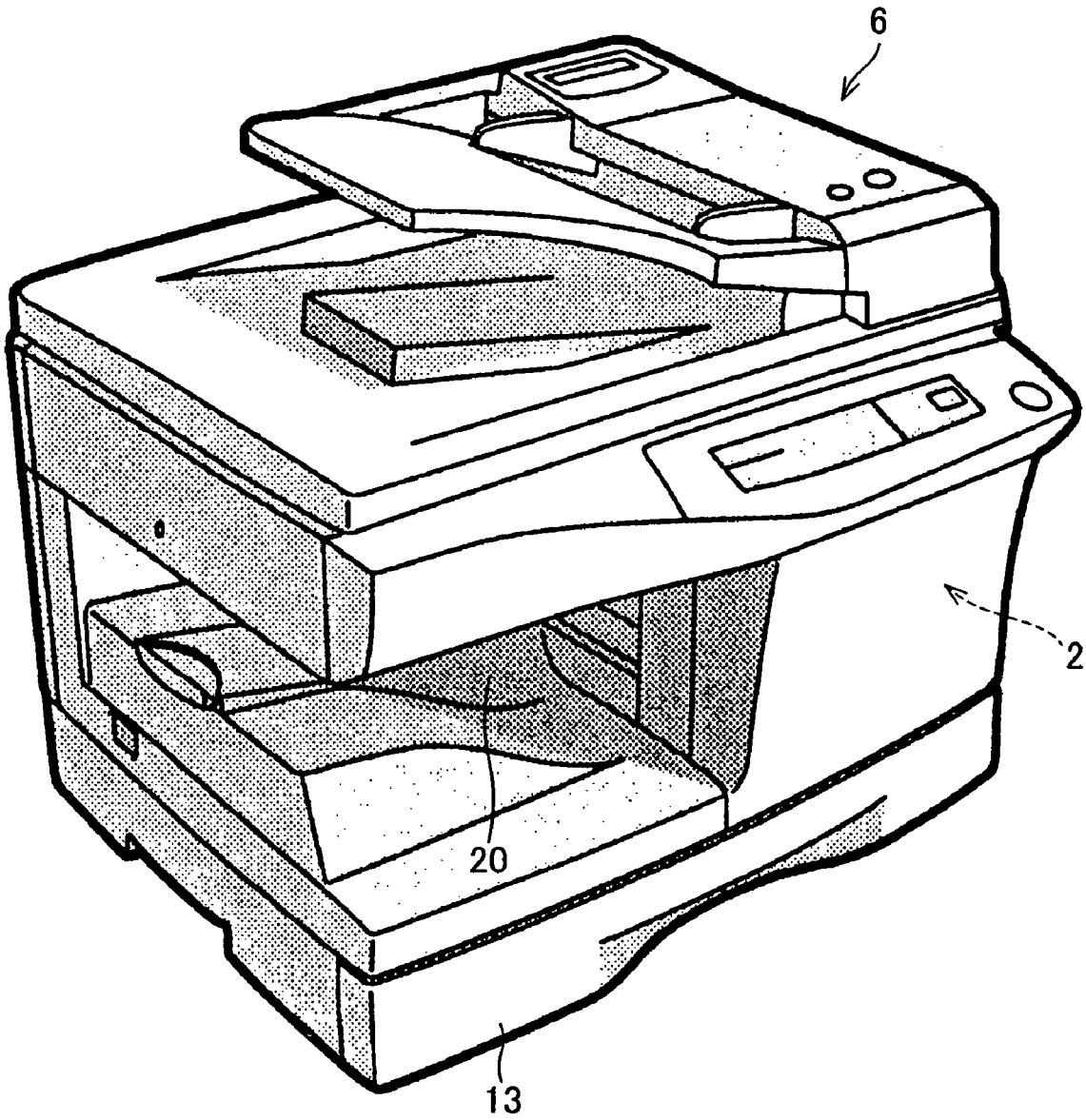
FIG. 3 is a perspective view showing an exterior of the image forming apparatus.
Figure 4:
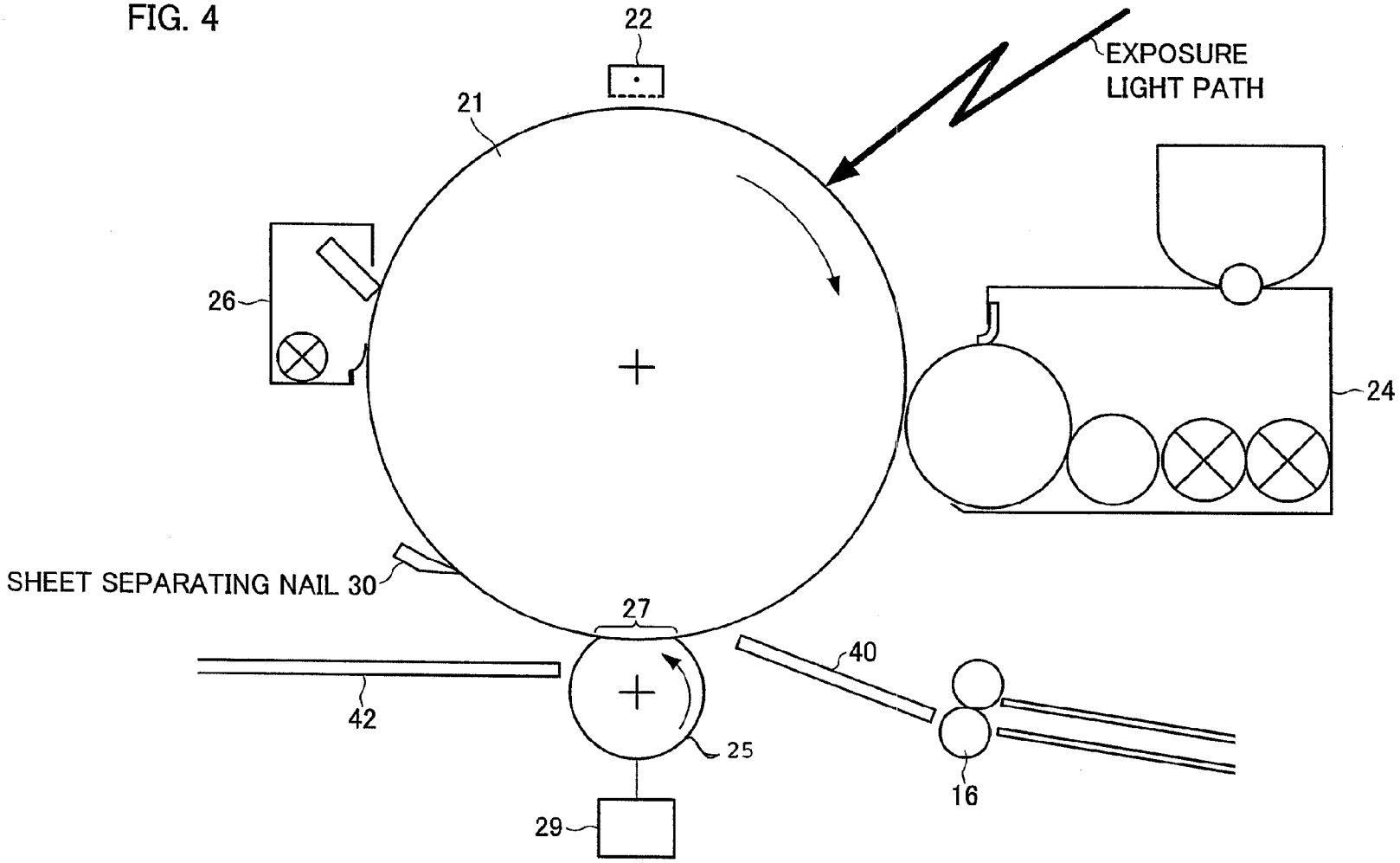
FIG. 4 is an explanatory diagram showing an arrangement of an image forming section of the image forming apparatus.

As shown in FIG. 2 that is a vertical cross-sectional view, an image forming apparatus of the present embodiment includes, along a direction in which a sheet (recording material) is conveyed, a sheet feeding section 1, an image forming section 2, a fixing section 3 and a sheet ejecting section 4, and an image scanning section 5 is provided above these sections. Further, an automatic document conveying device 6 that is an option is provided above the image scanning section 5. FIG. 3 shows an exterior of the present image forming apparatus, and FIG. 4 shows an arrangement of the image forming section 2.

Note that the following description in the present embodiment explains the image forming apparatus which can carry out both a black-and-white one-side printing and a black-and-white two-side printing. However, the present embodiment is not limited to this, and is applicable to a color image forming apparatus.

A document table 11 for mounting a document is provided near the image scanning section 5, and the automatic document conveying device 6 is provided above the document table 11 such that the automatic document conveying device 6 can be opened and closed. The automatic document conveying device 6 also functions as a document cover for preventing the mounted document from floating and for mounting the document in an appropriate place.

Image information of the document mounted on the document table 11 is read by an optical unit 12 provided under the document table 11. The image information read is subjected to an image processing by a control system 7, and is once stored in a memory (not shown) as the image information. Similarly, image information of a document conveyed by the automatic document conveying device 6 is read by the optical unit 12.

In the sheet feeding section 1, a sheet feeding cassette 13 is provided for housing sheets. The sheet in the sheet feeding cassette 13 is conveyed to a conveyance path 15 by the rotation of a sheet feeding roller 14. On the conveyance path 15 and in front of the image forming section 2, an idle roller 16 is provided. The conveyance of the sheet once stops when the front edge of the sheet reaches the idle roller 16. The idle roller 16 stops in order that the front edge of an image transfer region on the sheet and the front edge of a toner image visualized on a photoreceptor 21 described later are aligned with each other.

The image forming section 2 forms on the sheet the toner image based on the image information. As shown in FIG. 4, the image forming section 2 includes the photoreceptor 21 that is in the shape of a cylinder. Further, the image forming section 2 includes, around the photoreceptor 21, a main charging device 22, a laser scanner unit (not shown), a developing device 24, a transfer roller (transfer section) 25, a sheet separating nail 30, a cleaning section 26, etc.

The main charging device 22 applies a certain voltage to the photoreceptor 21 to charge the surface of the photoreceptor 21 at a predetermined potential. The laser scanner unit reads out the image information from the memory of the control system 7, and exposes the photoreceptor 21 with laser light modulated by the image information, so as to form on the photoreceptor 21 an electrostatic latent image based on the image information.

The laser scanner unit forms the electrostatic latent image based on (i) the image information of the document mounted on the document table 11 and read by the image scanning section 5, (ii) the image information of the document which is moving by the auto document conveying device 6 and (iii) image information transmitted from each terminal device on a network (not shown) connected to the present image forming apparatus.

The toner (developer) in the developing device 24 is supplied from a developing roller to the surface of the photoreceptor 21. In this way, the electrostatic latent image formed on the photoreceptor 21 is visualized, that is, the electrostatic latent image becomes a toner image. This visualization is realized in such a manner that the toner is deposited on the surface of the photoreceptor 21 in accordance with a potential contrast of the electrostatic latent image on the photoreceptor 21. A developing bias is applied to the developing roller so that the toner is easily deposited on the photoreceptor 21.

The toner image on the photoreceptor 21 is conveyed toward the transfer roller 25 by the rotation of the photoreceptor 21. Moreover, the rotation of the idle roller 16 is restarted. In this way, the toner image is transferred at an appropriate position on the sheet when the sheet passes through the transfer nip portion 27 where the photoreceptor 21 and the transfer roller 25 are compressed against each other. The transfer voltage is applied from the transfer voltage applying section 29 through the transfer roller 25 to the transfer nip portion 27, and the sheet absorbs the toner by the transfer voltage. Then, the sheet is separated from the photoreceptor 21 by the sheet separating nail 30, and is conveyed to the fixing process by the rotational forces of the photoreceptor 21 and the transfer roller 25. Note that details of the transfer process will be described later.

The toner image transferred to the sheet is conveyed to the fixing section 3 in the next process. The toner image is molten and fixed on the sheet by the heat and pressure of the fixing section 3. Note that the fixing section 3 includes a heating roller and a pressure roller.

The sheet on which the toner image is fixed is conveyed in a conveyance path 17. In the case of the one-side printing, the sheet is ejected through a sheet ejecting roller 19 onto a sheet ejecting tray 20. In the case of the two-side printing, the rear edge portion of the sheet is held by the sheet ejecting roller 19 to once stop the sheet when the sheet passes through the sheet ejecting roller 19. Then, the sheet is conveyed from the conveyance path 17 to a sub conveyance path 18 by reversely rotating the sheet ejecting roller 19.

Such technique of reversely conveying the sheet is generally called a "switchback conveyance", and the sub conveyance path 18 is also referred to as a switchback conveyance path. After the sheet is reversely conveyed and its front surface and back surface are reversed, the sheet again reaches the idle roller 16. The toner image newly visualized by the image forming section 2 on the basis of the image information to be printed on the back surface (second surface) is transferred to and fixed on the back surface of the sheet. Then, the sheet is ejected through the conveyance path 17 and the sheet ejecting roller 19 onto the sheet ejecting tray 20.

Note that the foregoing description explains a general printing procedure of an electrophotographic printing method, and it is clear that a post-processing unit, a paper feeding unit having a plurality of stages for housing various types of sheets, and a paper ejecting tray having a plurality of bins for easily sorting ejected sheets are applicable to the present image forming apparatus to realize multifunction.

The following will explain in detail the transfer process in the present image forming apparatus.

Again, in the case of the present image forming apparatus, the peripheral velocity of the transfer roller 25 is higher than that of the photoreceptor 21 due to the above-described reason. Therefore, the sheet is pulled due to the difference in the peripheral velocity between the photoreceptor 21 and the transfer roller 25, so that the sheet is separated from the photoreceptor 21. Note that the peripheral velocity of the idle roller 16 is the same as that of the transfer roller 25.

In the case of the present image forming apparatus, in the case in which the peripheral velocity of the photoreceptor 21 is V1 (mm/sec), the peripheral velocity of the transfer roller 25 is V2 (mm/sec) and the peripheral velocity of the idle roller 16 is V3 (mm/sec) in the present image forming apparatus, these V1, V2 and V3 are designed so as to satisfy $V1<V2\approx V3$ (that is, $V1<V2=V3$ (V3 ranges from $0.99\times V2$ to $1.012\times V2$)). Moreover, in order that the bended portion having a predetermined amount is formed in front of the transfer nip portion 27, these V1, V2 and V3 are designed so, as to satisfy $V1\times1.005\leqq V2\approx V3\leqq V1\times1.03$.

Moreover, the sheet conveyed from the idle roller 16 is conveyed to a contact point of the transfer nip portion 27 in such a direction that the front edge of the sheet proceeds toward an outer circumference of the photoreceptor 21. After the front edge of the sheet first contacts with the photoreceptor 21, the sheet is conveyed to the transfer nip portion 27 by the rotation of the photoreceptor 21.

Figure 5:
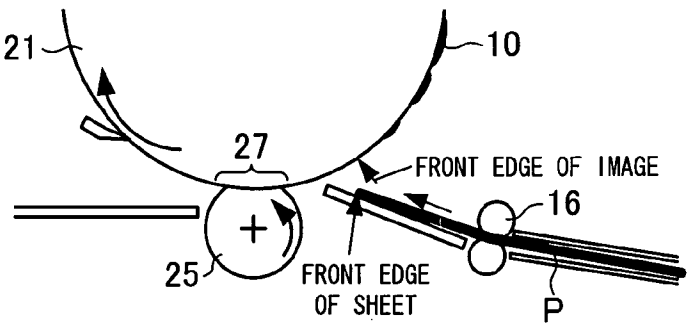
FIGS. 5(*a*) to 5(*e*) are explanatory diagrams showing how a sheet is conveyed to a transfer nip portion of the image forming apparatus.
Figure 5:
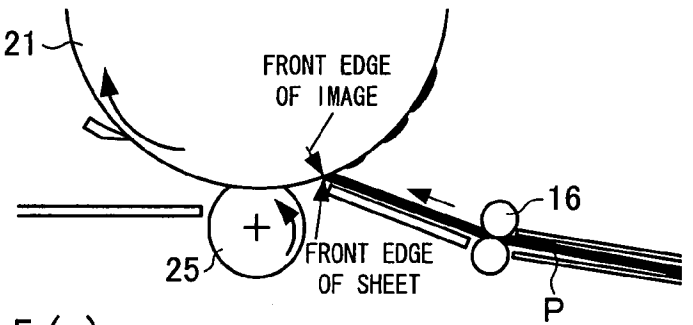
Figure 5:
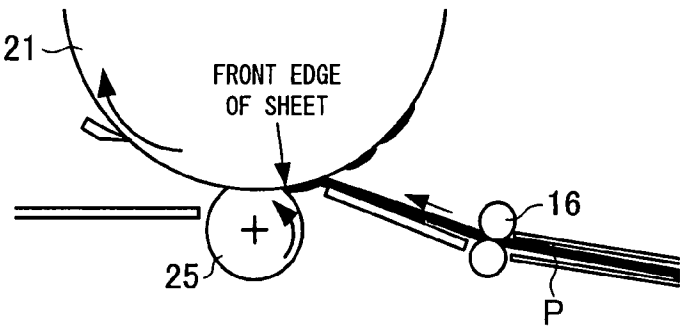
Figure 5:
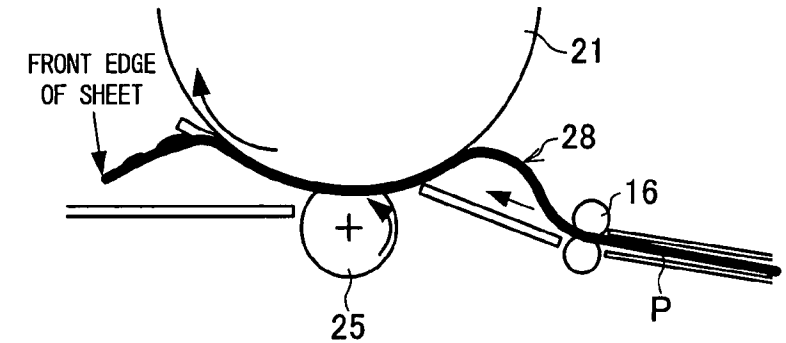
Figure 5:
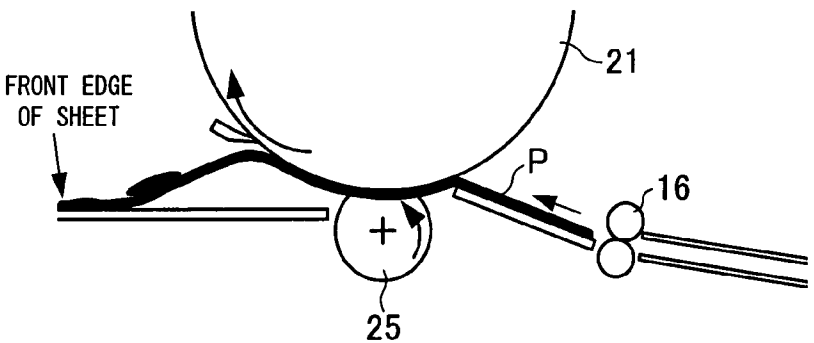

FIGS. 5(*a*) to 5(*e*) show how the sheet P is conveyed to the transfer nip portion 27. The toner image 10 formed on the photoreceptor 21 is conveyed to the transfer nip portion 27 by the rotation of the photoreceptor 21, and the sheet P is conveyed to the transfer nip portion 27 by the rotation of the idle roller 16. The sheet P conveyed from the idle roller 16 is conveyed to the contact point of the transfer nip portion 27 by the guidance of a paper guide 40 in such a direction that the front edge of the sheet P proceeds toward the outer circumference of the photoreceptor 21. Therefore, the sheet P first contacts with the photoreceptor 21. Then, the sheet P is guided to the transfer nip portion 27 by the rotation of the photoreceptor 21. The sheet P and the photoreceptor 21 contact with each other so that the front edge of the toner image 10 and the front edge of a region where on the sheet P the image is formed (that is, the front edge of a region obtained by omitting from the entire region of the sheet a blank space (front edge void) provided at the front edge portion) match with each other by controlling the timing of the restart of the rotation of the idle roller 16.

The sheet P passes through the transfer nip portion 27, and the toner image 10 is transferred onto the sheet P. The front edge portion of the sheet P is separated from the photoreceptor 21 by the sheet separating nail 30, and the sheet P is conveyed along a paper guide 42. Moreover, as described above, a portion which has not yet passed through the transfer nip portion 27 sequentially passes through the transfer nip portion 27 while forming the bended portion 28 in front of the transfer nip portion 27. After the rear edge of the sheet P finishes passing through the idle roller 16, the bended portion 28 disappears, and the rear edge portion of the sheet P is conveyed along the paper guide 40.

In the image forming apparatus arranged as above, in the case in which a large amount of toner is between the photoreceptor 21 and the sheet P due to the reduction in the particle diameter of the toner, the sheet P slips with respect to the photoreceptor 21 and the rear edge of the toner image transferred onto the sheet moves backward. Thus, the rear edge void reduces or disappears. Therefore, the toner remaining on the photoreceptor 21 causes stain, and the printing quality (image quality) deteriorates because of no blank space. In addition to these, in the case of the present image forming apparatus adopting the switchback conveyance method, there are problems in that for example, when printing onto the second surface for the two-side printing, the jam occurs at the fixing section 3.

In order to prevent the reduction or disappearance of the blank space at the rear edge void, the following countermeasures are taken in the present image forming apparatus. That is, the present image forming apparatus includes (i) an image elongation predicting section (image elongation predicting means) for predicting an occurrence of an image elongation, in other words, predicting that, due to slipping of a sheet P with respect to a photoreceptor at a transfer nip portion 27, a toner image transferred is lengthened on the sheet P and (ii) a bending amount adjusting section (bending amount adjusting means) for, if the image elongation predicting section predicts that the image elongation occurs, variably controlling a peripheral velocity of the idle roller 16 after a front edge of the sheet P has reached the transfer nip portion 27, the peripheral velocity being variably controlled so that the sheet P has the reduced bended portion 28 which is formed in front of the transfer nip portion 27 (which is formed between a transfer roller 27 and the idle roller 16).

Figure 6:
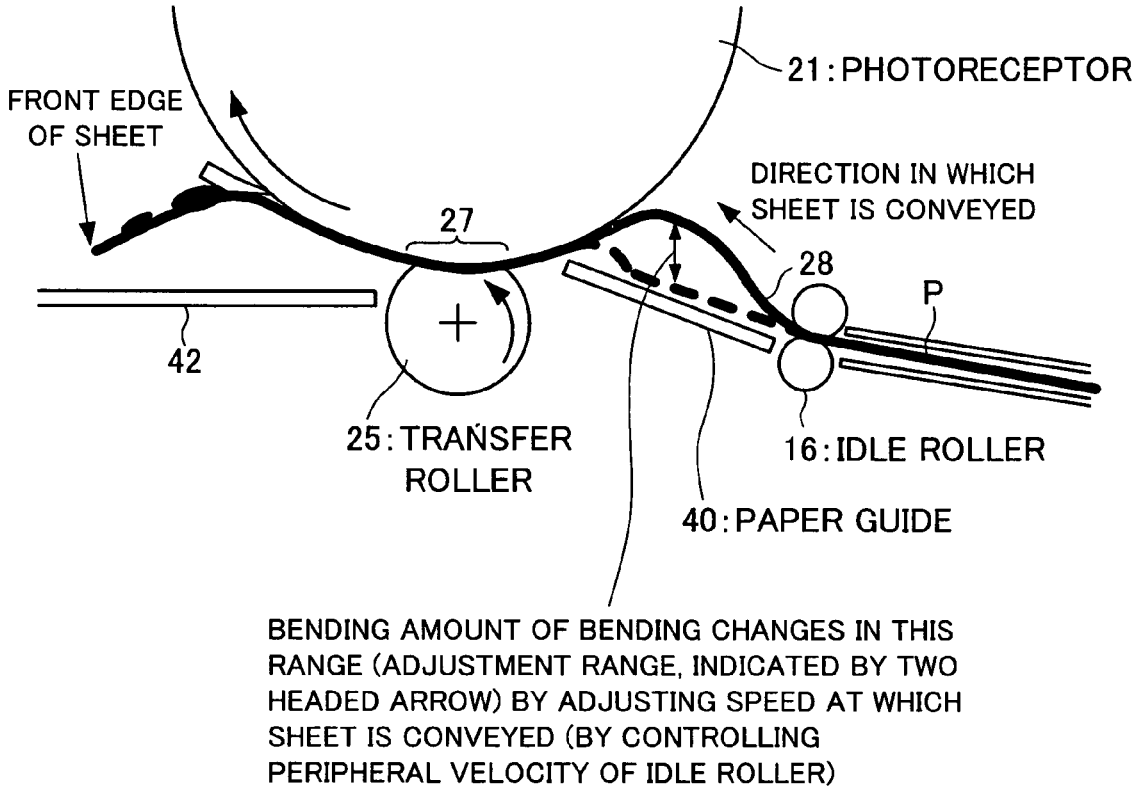
FIG. 6 is an explanatory diagram showing an adjustment range of a bending amount of a bended portion formed between the transfer nip portion and an idle roller.

According to this, the image elongation predicting section predicts the occurrence of the image elongation, in other words, predicts that the toner image is lengthened on the sheet P at the time of transferring of the toner image. Then, if the image elongation predicting section predicts that the image elongation occurs, the bending amount adjusting section variably controls the peripheral velocity of the idle roller 16 after the front edge of the sheet P has reached the transfer nip portion 27, the peripheral velocity being variably controlled so that the bended portion 28 of the sheet P is reduced in size. FIG. 6 shows an adjustment range of the bending amount of the bended portion 28. Note that the adjustment range of the bending amount is a range in which the bending amount changes by controlling the peripheral velocity of the idle roller 16. The peripheral velocity of the idle roller 16 is controlled by reducing an electrical power to be supplied to a driving source (not shown) of the idle roller 16, by changing a duty of a pulse, or the like.

As described above, the longer the length of the sheet P in the direction in which the sheet is conveyed becomes, the larger the bended portion 28 formed in front of the transfer nip portion 27 becomes. In addition, since the bended portion 28 intends to become flat, the sheet P is pushed in the direction in which the sheet P is conveyed. Therefore, the bended portion 28 is one of factors for causing the slip phenomenon that is the phenomenon of slipping of the sheet P with respect to the photoreceptor 21.

Thus, by adjusting the bending amount so that the bended portion 28 is reduced in size, it is possible to (i) suppress or prevent the occurrence of the slip phenomenon effectively, (ii) surely secure the rear edge void and (iii) appropriately avoid the above-described problems caused due to the reduction or disappearance of the rear edge void.

In addition, in this case, the bended portion 28 does not completely disappear, but is just reduced in size so that the slip phenomenon does not occur. Therefore, it is possible to obtain an effect obtained by forming the bended portion 28, that is, an effect of avoiding a problem in which, before the sheet P reaches the transfer nip portion 27, the sheet P sticks to the transfer roller 25 so as to be charged unnecessarily.

Further, the present image forming apparatus is so arranged as to include an image elongation occurring area specifying section (image elongation occurring area specifying means) for specifying an image elongation occurring area on the electrostatic latent image, the image elongation occurring area being an area having such a possibility that the image elongation occurs. In addition, in the present image forming apparatus, the bending amount adjusting section variably controls the peripheral velocity of the idle roller 16 so that the bended portion 28 is reduced in size when the image elongation occurring area specified by the image elongation occurring area specifying section has reached the transfer nip portion 27.

Therefore, the bended portion 28 having an appropriate amount is secured in front of the transfer nip portion 27 while an area not having such a possibility that the slip phenomenon occurs is passing through the transfer nip portion 27, but the bended portion 28 is reduced in size only while the area having such a possibility that the slip phenomenon occurs is passing through the transfer nip portion 27. Therefore, the bended portion 28 which provides the above-described effect is not reduced in size while an area which does not require the reduction in size of the bended portion 28 is passing through the transfer nip portion 27. On this account, it is possible to effectively obtain the effect obtained by forming the bended portion 28.

Further, it is preferable that the bending amount adjusting section variably control the peripheral velocity of the idle roller 16 so that not only the bended portion 28 is reduced in size but also the bending amount of the bended portion 28 shifts within a certain range of amount which does not cause the slip phenomenon. In this case, since the size of the bended portion 28 shifts within the certain range of amount which does not cause the slip phenomenon, it is possible to effectively suppress the image elongation caused due to the slip phenomenon.

Figure 1:
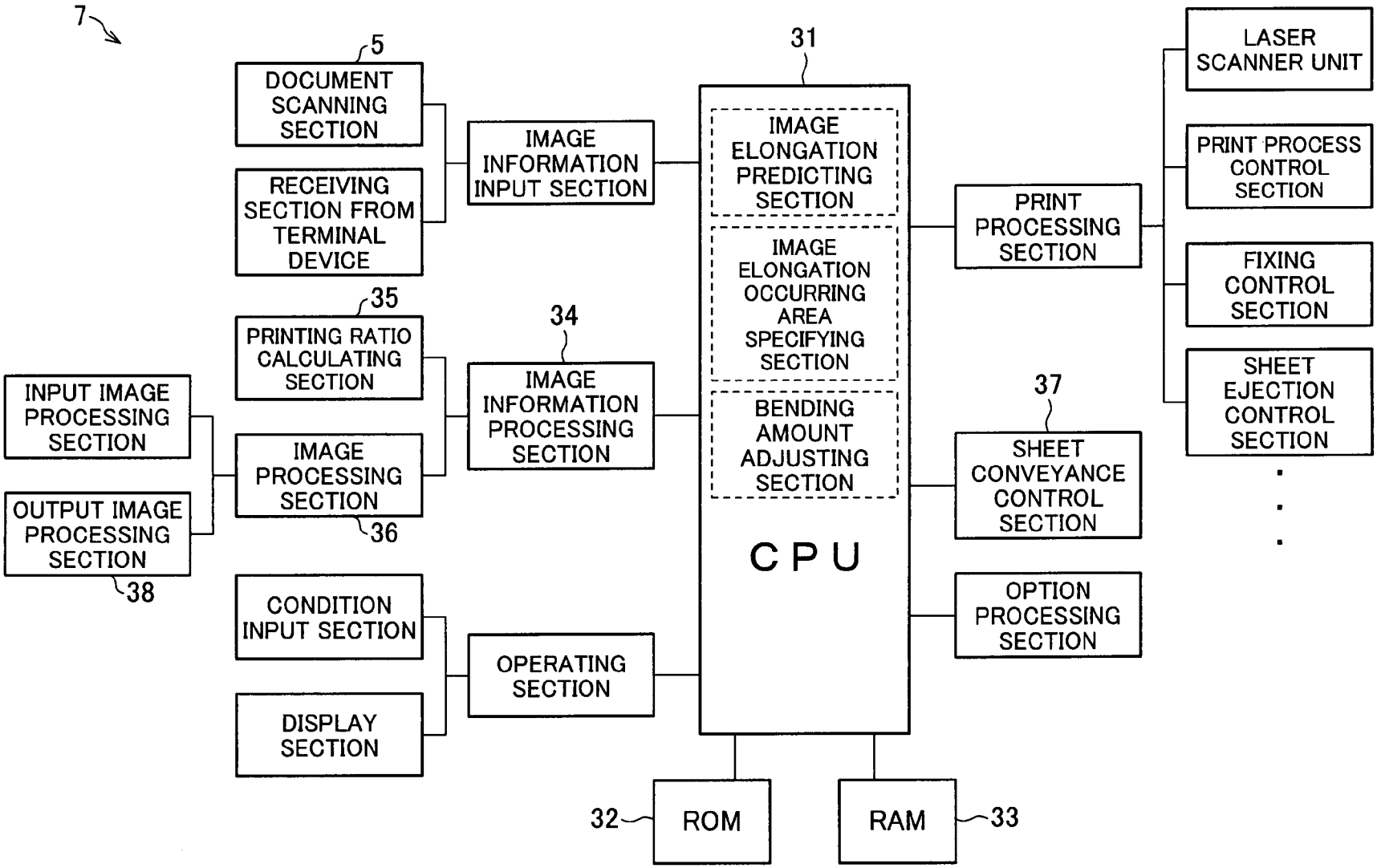
FIG. 1 shows one embodiment of the present invention and is a block diagram showing an arrangement of a control section of an image forming apparatus.

The image elongation predicting section, the image elongation occurring area specifying section and the bending amount adjusting section are realized by a CPU 31, a ROM 32 and a RAM 33 which are included in the control system 7 shown in FIG. 1 and a printing ratio calculating section 35 in an image information processing section 34. FIG. 1 is a block diagram showing an arrangement of the control system 7 of the present image forming apparatus.

The CPU 31 is a brain for controlling all the operations of the image forming apparatus. That is, the CPU 31 receives from an image information input section the image information transmitted from the terminal device and/or the image information read by the image scanning section 5. Then, the CPU 31 causes the image information processing section 34 to process the image information in accordance with instructions, such as a print condition, a print request, etc., supplied from an operating section, such as a condition input section, a display section, etc.

Then, the CPU 31 supplies the processed image information to a print processing section. Then, the CPU 31 controls the laser scanner unit, a print process control section for controlling the image forming section 2, a fixing control section for controlling the fixing section 3, a sheet ejection control section for controlling the sheet ejecting section 4, etc., and also causes a sheet conveyance control section 37 to control a sheet conveying system, such as the sheet feeding section 1, the idle roller 16, etc. In this way, the image is formed on the sheet P having a predetermined size instructed. Moreover, the CPU 31 also causes an option processing section to control an option device, such as the automatic document conveying device 6, etc.

The image information processing section 34 includes, as an image processing section 36, (i) an input image processing section for carrying out a predetermined image processing with respect to the image information supplied through the image information input section and (ii) an output image processing section 38 for carrying out a predetermined image processing with respect to image data, processed by the input image processing section, so as to obtain output image data for forming a write image outputted to the print processing section. The image information processing section 34 further includes the printing ratio calculating section 35 for calculating the printing ratio on the basis of the output image data once processed by the output image processing section 38.

As a factor for predicting the occurrence of the image elongation, the CPU 31 uses a result of a calculation carried out by the printing ratio calculating section 35 (a function as the image elongation predicting section).

Moreover, the CPU 31 specifies the image elongation occurring area of the electrostatic latent image on the basis of the result of the calculation carried out by the printing ratio calculating section 35 (a function as the image elongation occurring area specifying section). On the basis of the printing ratio calculated per line by the printing ratio calculating section 35, the CPU 31 can specify in which region (image elongation occurring area) in the image the image elongation occurs.

Further, if the image elongation predicting section predicts that the image elongation occurs, the CPU 31 controls through the sheet conveyance control section 37 the peripheral velocity of the idle roller 16 so that the bended portion 28 of the sheet P is reduced in size, although the idle roller 16 is conventionally caused to rotate at a constant peripheral velocity until the rear edge of the sheet P finishes passing through the idle roller 16. Here, the peripheral velocity of the idle roller 16 is variably controlled so that the bended portion 28 is small when the image elongation occurring area specified has reached the transfer nip portion 27. More specifically, the bending amount of the bended portion 28 is obtained on the basis of a difference between the peripheral velocity of the photoreceptor 21 and the peripheral velocity of the idle roller 16, and the peripheral velocity of the idle roller 16 is variably controlled so that the bending amount does not exceed an amount (that is determined in advance) which causes the slip phenomenon.

Such control of the rotation of the idle roller 16 is carried out after the front edge of the sheet P has reached the transfer nip portion 27. This is because, if such control is carried out before the front edge of the sheet P has reached the transfer nip portion 27, the sheet P and the toner image 10 would not be aligned with each other. After the sheet P has reached the transfer nip portion 27, the sheet P is conveyed by a conveyance power of the transfer nip portion 27 (conveyance powers of the transfer roller 25 and the photoreceptor 21). Therefore, the bended portion 28 is reduced in size by reducing the peripheral velocity of the idle roller 16.

In variably controlling the peripheral velocity of the idle roller 16, the CPU 31 controls the peripheral velocity of the idle roller 16 in a range from 1.005 times to 1.03 times the peripheral velocity (V1) of the photoreceptor 21. By controlling the peripheral velocity of the idle roller 16 in such range, the bended portion 28 can be reduced in size so as not to cause the slip phenomenon, while the bended portion 28 does not disappear and the effect obtained by the bended portion 28 is secured.

Moreover, on the basis of an elapsed time since the restart of the rotation of the idle roller 16, the CPU 31 detects whether the front edge of the sheet has reached the transfer nip portion 27 or not. As described above, in order that the sheet and the toner image on the photoreceptor 21 are aligned with each other, the rotation of the idle roller 16 is once stopped when the front edge of the sheet reaches the idle roller 16 and the rotation of the idle roller 16 is restarted at such a timing that the toner image on the photoreceptor 21 passes through the transfer nip portion 27. Therefore, on the basis of the elapsed time since the restart of the rotation of the idle roller 16 which is restarted rotating so that the sheet is conveyed to the transfer nip portion 27, it is possible to judge whether the front edge of the sheet has reached the transfer nip portion 27 or not. In the case of this detection method, it is possible to detect whether the front edge of the sheet has reached the transfer nip portion 27 or not by a configuration whose number of members (sections) is smaller than the number of members in a configuration of additionally including a sensor, etc. for detecting whether the front edge of the sheet has passed through the transfer nip portion 27 or not.

The ROM 32 includes the functions of the image elongation predicting section, the image elongation occurring area specifying section and the bending amount adjusting section, and stores various programs used by the CPU 31 for causing the present image forming apparatus to function and data, such as the number of steps of a motor, etc. The RAM 33 is a storage section (memory) used by the CPU 31.

The following will explain a prediction of the occurrence of the image elongation. As a result of diligent studies, the inventors of the present application found that the slip phenomenon of the sheet P which phenomenon causes the image elongation closely relates to the printing ratio of a region on the sheet P which region passes through the transfer nip portion 27 while the bended portion 28 exists. The inventors further found that it is possible to effectively predict the occurrence of the image elongation on the basis of the printing ratio of the above-described region of the sheet P.

Figure 7:
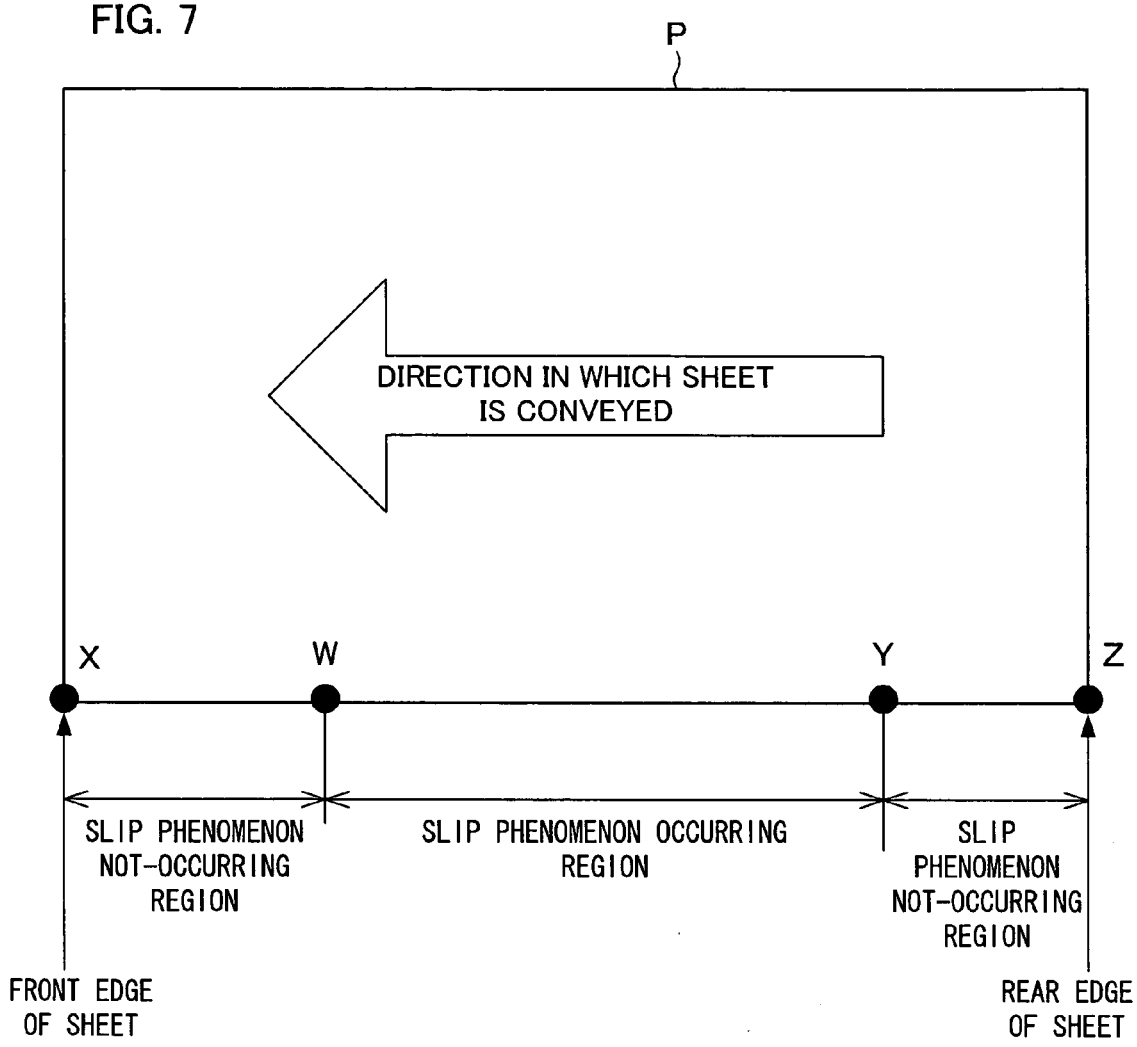
FIG. 7 is an explanatory diagram showing a slip phenomenon occurring region on a sheet used by the image forming apparatus, and the slip phenomenon occurring region is determined depending on a length of the sheet in a direction in which the sheet is conveyed.

The bended portion 28 disappears after the rear edge of the sheet P finishes passing through the idle roller 16. Therefore, as shown in FIG. 7, a certain region (Y-Z) which passes through the transfer nip portion 27 after the rear edge of the sheet P finishes passing through the idle roller 16 is a slip phenomenon not-occurring region where no slip phenomenon occurs no matter how high the printing ratio is. The length of this region in the direction in which the sheet is conveyed is substantially equal to the separation distance between the transfer nip portion 27 and the idle roller 16.

Moreover, it is empirically confirmed that a certain region (X-W) is also a region where no slip phenomenon occurs no matter how high the printing ratio is. This is because the bended portion 28 is not formed sufficiently. Therefore, the certain region (X-W) which passes through the transfer nip portion 27 before the bended portion 28 is sufficiently formed is also the slip phenomenon not-occurring region. Note that the slip phenomenon not-occurring region (X-W) at the front edge of the sheet varies depending on the differences in peripheral velocity between the photoreceptor 21 and the transfer roller 25 and between the photoreceptor 21 and the idle roller 16, the amount of the bended portion 28, etc.

In the present image forming apparatus, on the basis of a printing ratio of a slip phenomenon occurring region (W-Y) that is a region between the slip phenomenon not-occurring region (X-W) at the front edge of the sheet and the slip phenomenon not-occurring region (Y-Z) at the rear edge of the sheet, the CPU 31 predicts the occurrence of the image elongation and specifies the image elongation occurring area of the electrostatic latent image. The printing ratio calculating section 35 calculates the printing ratio of the sheet P to which the toner image is transferred on the basis of the image information, and the printing ratio of the slip phenomenon occurring region (W-Y) can be obtained from the printing ratio of the sheet P.

On the basis of the output image data processed by the output image processing section 38, the printing ratio calculating section 35 calculates the printing ratio per a plurality of scanning lines or per one scanning line. In the present image forming apparatus, the printing ratio calculating section 35 calculates the printing ratio per one line. As an example of a case in which the printing ratio calculating section 35 calculates the printing ratio per a plurality of scanning lines, the printing ratio can be obtained per a nip size (a size in the direction in which the sheet is conveyed) of the transfer nip portion 27. If the resolution is 600 Ddpi and the transfer nip is 2.5 mm, the printing ratio can be calculated per 60 sub-scanning lines.

The printing ratio of 60 sub-scanning lines can be obtained on the basis of the output image data by the following equation (1).

$$(\Sigma(\text{the total number of pixels in the image in 60 sub-scanning lines})/(\Sigma(\text{the total number of pixels in 60 sub-scanning lines}))\times 100\% \quad (1)$$

The total number of pixels in the image in 60 sub-scanning lines is the total number of valid pixels to which the toner is deposited (which form dots) in 60 sub-scanning lines. The total number of pixels in 60 sub-scanning lines is a value determined depending on the size of the sheet P in a main scanning direction (that is, in a direction orthogonal to the direction in which the sheet is conveyed). In the case in which the left edge void and/or the right edge void are provided, the pixels in these voids are included in the total number of pixels in 60 sub-scanning lines as invalid pixels to which the toner is not deposited (which do not form dots).

In the case of the color image forming apparatus which forms an image by, for example, four colors that are cyan, magenta, yellow and black, the printing ratio of each color is calculated, the printing ratios calculated are added, and the printing ratios added are averaged. That is, if the printing ratio is calculated for every 60 lines, in the case in which the printing ratios obtained for cyan, magenta, yellow and black by using the above equation (1) are Z1, Z2, Z3 and Z4, respectively, the printing ratio calculating section 35 carries out the addition of Z1, Z2, Z3 and Z4, and divides the sum of Z1, Z2, Z3 and Z4 by four that is the number of colors.

The ROM 32 (or the RAM 33) stores in advance (i) a sheet size(s) (a size in the direction in which the sheet is conveyed) having such a possibility that the image elongation occurs and (ii) the printing ratio(s) having such a possibility that the image elongation occurs. On the basis of the sheet size selected and the printing ratio obtained by the printing ratio calculating section 35, the CPU 31 predicts whether or not the image elongation occurs. Here, the printing ratio having such a possibility that the image elongation occurs is determined for each sheet size. The larger the sheet size is, the larger the bended portion 28 becomes. Then, the larger the bended portion 28 becomes, the more often the image elongation occurs and the larger the number of occurrences of the image elongation becomes. Therefore, as the sheet size becomes larger, the CPU 31 more often predicts that the image elongation occurs even when the printing ratio is low.

The relation between the possibility of the occurrence of the image elongation and the printing ratio can be obtained by repeatedly carrying out such test that the amount of the rear edge void reduced (that is, the amount of the image lengthened) is measured while variously changing a combination of the printing ratio and the sheet size (the size in the direction in which the sheet is conveyed).

For example, in the case of the present image forming apparatus, even in the case in which no countermeasure is taken with respect to the image elongation caused due to the slip phenomenon, no image elongation had occurred irrespective of the printing ratio when the sheet size in the direction in which the sheet is conveyed is smaller than A4 vertical size, that is, when the sheet size is A4 that is fed horizontally or smaller. On this account, on the basis of information stored based on the above-described actual measurement and irrespective of the calculation result of the printing ratio calculating section 35, the CPU 31 predicts that the image elongation does not occur when the size of the sheet P is A4 that is fed horizontally or smaller. Meanwhile, in the case in which the size of the sheet P is A4 that is fed vertically and the number of lines each having the printing ratio which is calculated by the printing ratio calculating section 35 and is more than a predetermined value (for example, 70%) is equal to or more than a predetermined number in the image, the CPU 31 predicts that the image elongation occurs. In the case in which the size of the sheet P is A3 and the number of lines each having the printing ratio which is more than a predetermined value (for example, 40%) that is lower than the above value is equal to or more than a predetermined number in the image, the CPU 31 predicts that the image elongation occurs.

Figure 8:
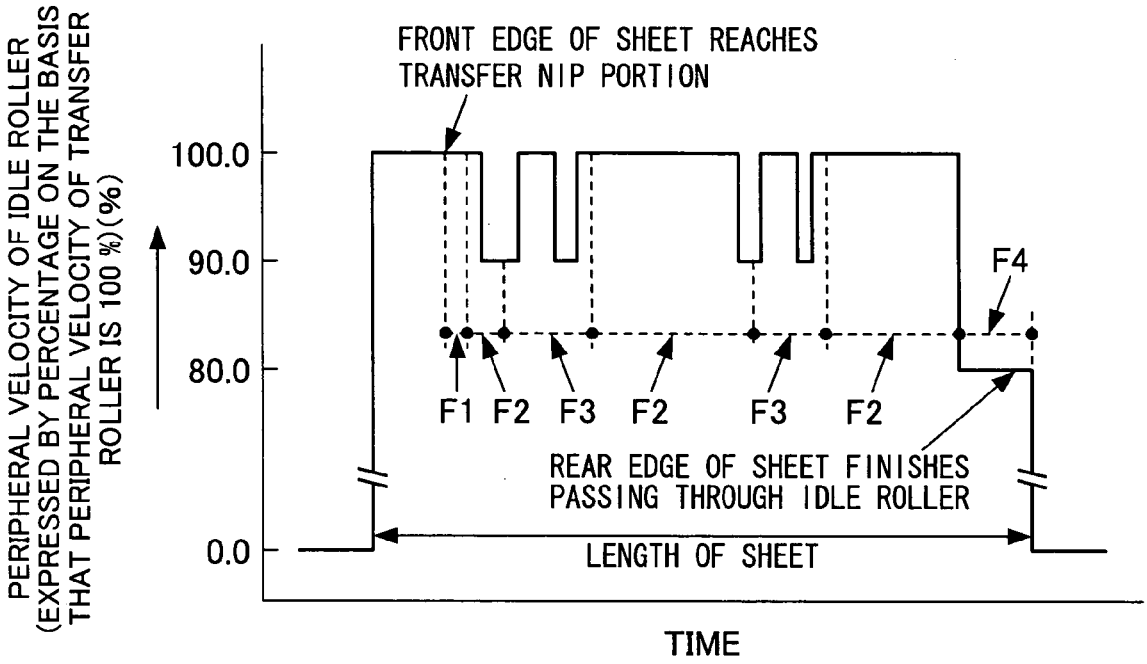
FIG. 8 is an explanatory diagram showing how a peripheral velocity of the idle roller is variably controlled, and this explanatory diagram is shown by a relation of the peripheral velocity of the idle roller, a time and a length of the sheet.

The following will explain one example of controlling the driving of the idle roller 16. In FIG. 8, a referential mark F1 indicates a bending growing period in which the front edge of the sheet P reaches the transfer nip portion 27 and the bended portion 28 starts growing, a referential mark F2 indicates a period in which a portion which is in the toner image and whose printing ratio is low (for example, 40% or lower in an A3 sheet) is transferred to the sheet P at the transfer nip portion 27, a referential mark F3 is a period in which a portion which is in the toner image and whose printing ratio is high (for example, more than 40% in the A3 sheet) is transferred to the sheet P at the transfer nip portion 27, and a reference mark F4 indicates a period in which the rear edge of the sheet P has separated from the idle roller 16 and the sheet P does not have the bended portion 28 any more.

In the case in which the CPU 31 judges, in the period in which the bended portion 28 is growing (that is, in the reference mark F1 in FIG. 8), that there is a portion whose printing ratio is high on the basis of the calculation result of the printing ratio calculating section 35, the CPU 31 (i) specifies a region to which the portion whose printing ratio is high is transferred, (ii) detects that the image elongation occurs in a region between what millimeters and what millimeters from the front edge of the sheet P, and (iii) specifies a portion which causes the slipping. Then, the peripheral velocity of the idle roller 16 is controlled so that the bended portion 28 is reduced in size before a region which is in the sheet P and corresponds to the portion which causes the slipping reaches the transfer nip portion 27. Here, the bended portion 28 is reduced in size by using the change in the duty in the pulse control in the driving source of the idle roller 16.

According to diligent studies by the inventors, the frequency of occurrence of the slip phenomenon causing the image elongation changes depending on (i) the thickness of the sheet P, (ii) the smoothness of the sheet P and (iii) the humidity and temperature in the image forming apparatus (apparatus internal environment information), which (i), (ii) and (iii) are not adopted in the present image forming apparatus, though.

For example, as the thickness of the sheet P increases, the stiffness of the sheet P also increases. Therefore, even in the case in which, for example, two sheets have the same size, the thicker sheet is stiffer than the thinner sheet and the thicker sheet slips more than the thinner sheet, and the amount of the image lengthened is larger in the thicker sheet than in the thinner sheet. The thickness is shown by a basis weight. A piece of standard paper has the basis weight of from 80 $g/m^2$ to 100 $g/m^2$, and a piece of heavy paper, such as a postcard, has the basis weight of 200 $g/m^2$ or more. Meanwhile, as the smoothness of the sheet P deteriorates, the surface of the sheet P becomes rough and uneven. Therefore, the toner moves as if the toner rolls on the uneven surface. That is, the sheet P easily slips, and the amount of the image lengthened becomes large.

Moreover, like the thickness of the sheet P, the temperature and humidity in the image forming apparatus change the stiffness of the sheet P. For example, the stiffness of the sheet P decreases (disappears) under conditions of high temperature and high humidity. Therefore, the sheet P hardly slips and the amount of the image lengthened becomes small. In contrast, the stiffness of the sheet P increases under conditions of low temperature and low humidity. Therefore, the sheet P easily slips and the amount of the image lengthened becomes large.

The prediction of the occurrence of the image elongation may be carried out on the basis of not only the sheet size and the printing ratio but also the sheet size, the printing ratio and at least one of (i) the thickness of the sheet P, (ii) the surface smoothness of the sheet P and (iii) the apparatus internal environment information.

Figure 9:
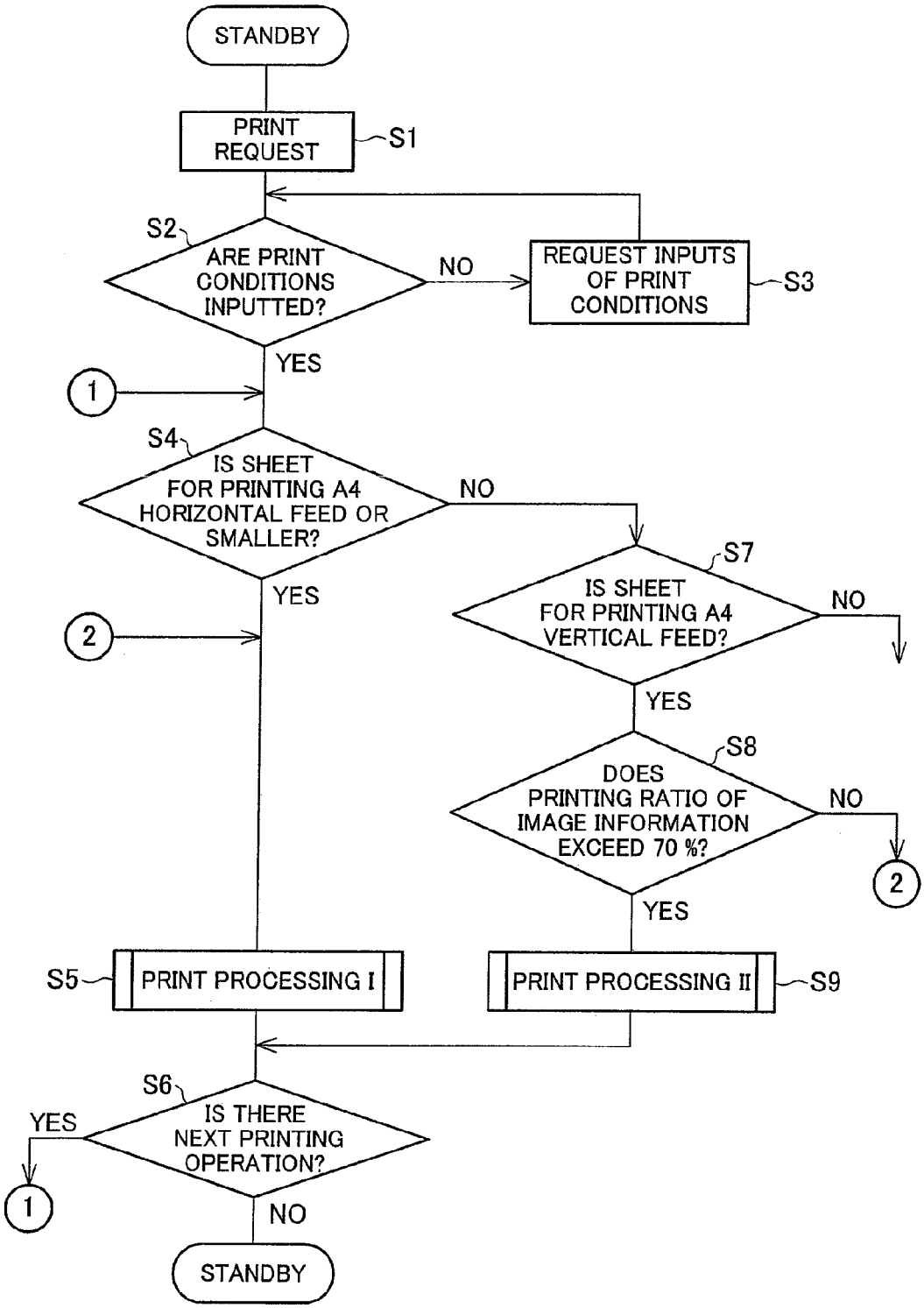
FIG. 9 is a flow chart showing steps for carrying out a printing by the image forming apparatus.

The following will explain image-forming operations carried out by the present image forming apparatus arranged as above in reference to a flow chart of FIG. 9.

After the print request is supplied to the present image forming apparatus that is in a standby state (S1) and print conditions are inputted, the CPU 31 checks necessary print conditions (S2). If the necessary print conditions are not inputted, the CPU 31 requests the input of the necessary print conditions (S3).

The print conditions to be checked here are, for example, (i) the sheet size of the sheet used for printing, (ii) whether the printing is the one-side printing or the two-side printing, (iii) an image density and (iv) print magnification, which (iii) and (iv) are necessary for calculating the printing ratio in a state in which the image based on the image information requested to be printed is formed on the sheet P.

After the CPU 31 checks the inputs of the necessary print conditions, the CPU 31 judges whether or not the sheet size instructed is A4 that is fed horizontally or smaller (S4). If the sheet size is A4 that is fed horizontally or smaller, the CPU 31 judges that the image elongation does not occur. In this case, the CPU 31 does not variably control the idle roller 16 and carries out a normal print processing I (S5). Then, the CPU 31 checks whether there is a next printing operation or not. If there is the next printing operation, the process returns to S1. If there is no next printing operation, the image forming apparatus enters the standby state.

Meanwhile, if the sheet size instructed is not A4 that is fed horizontally or smaller, the CPU 31 judges whether or not the sheet size is A4 that is fed vertically (S7). If the sheet size is A4 that is fed vertically, the process proceeds to S8, and the CPU 31 judges whether or not the number of lines each having the printing ratio which is calculated by the printing ratio calculating section 35 and is more than a predetermined value (70%, for example) is equal to or more than a predetermined number. If the number of lines is equal to or more than the predetermined number, the CPU 31 carries out a print processing II in which the peripheral velocity of the idle roller is variably controlled so that the slip phenomenon does not occur (S9). Then, the CPU 31 checks whether there is a next printing operation or not. If there is the next printing operation, the process returns to S1. If there is no next printing operation, the image forming apparatus enters the standby state.

Figure 10:
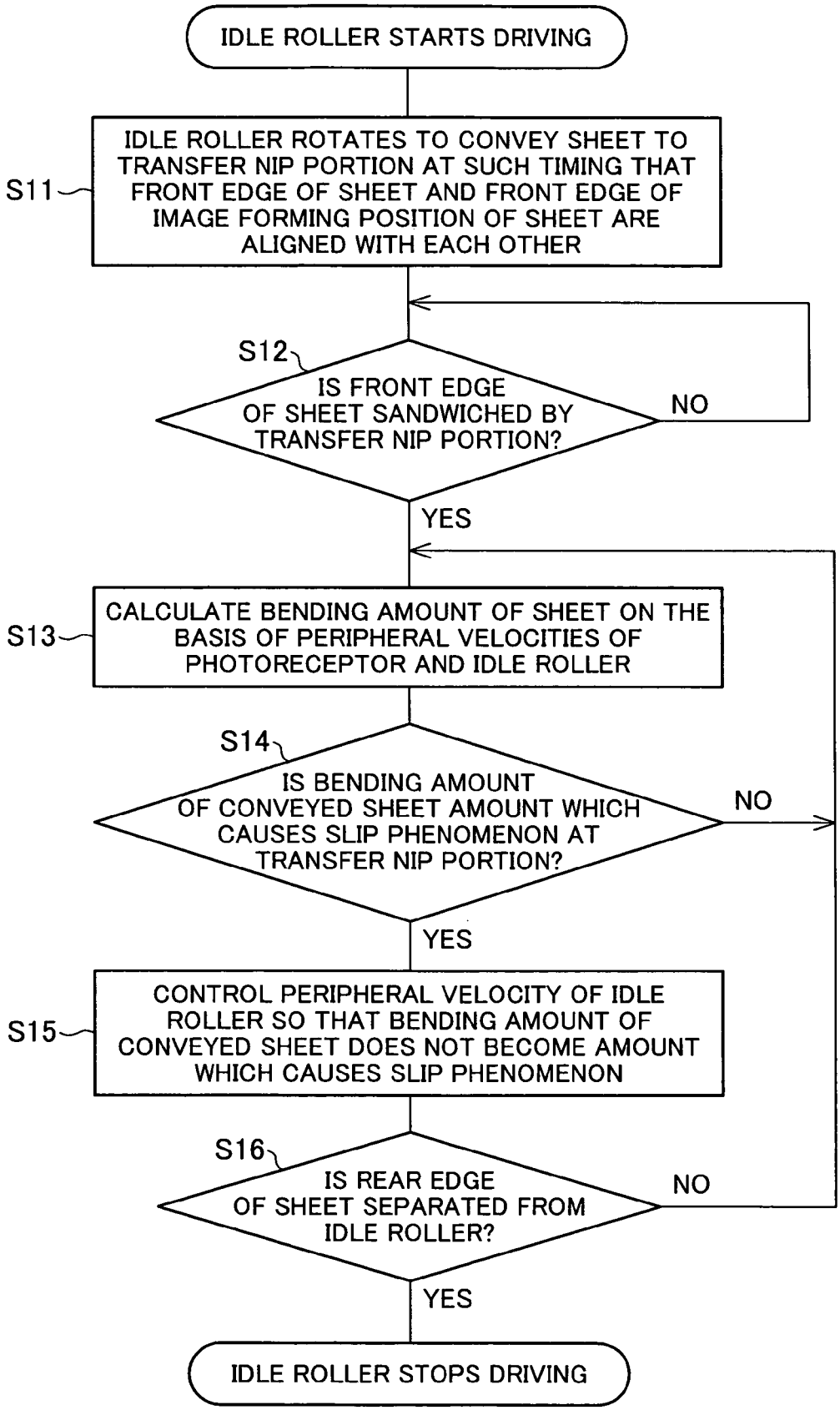
FIG. 10 is a flow chart showing steps for an operation of the idle roller in the image forming apparatus.
Figure 11:
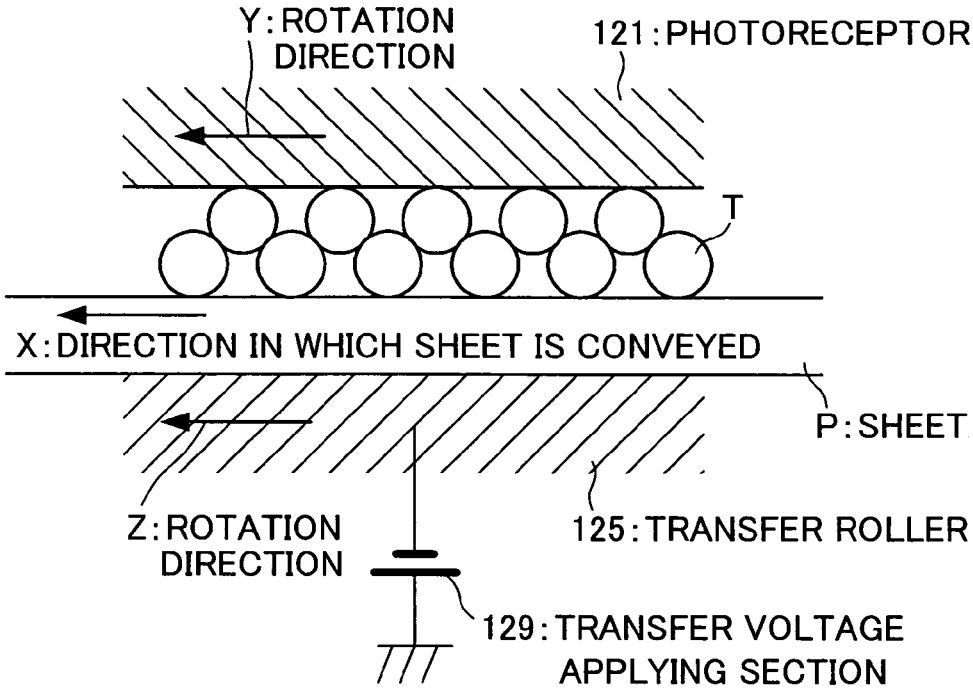
FIGS. 11(*a*) and 11(*b*) are explanatory diagrams showing a mechanism of a decrease in an absorptive power between a photoreceptor and a sheet, and the decrease is caused due to a decrease in particle diameter of a toner.
Figure 11:
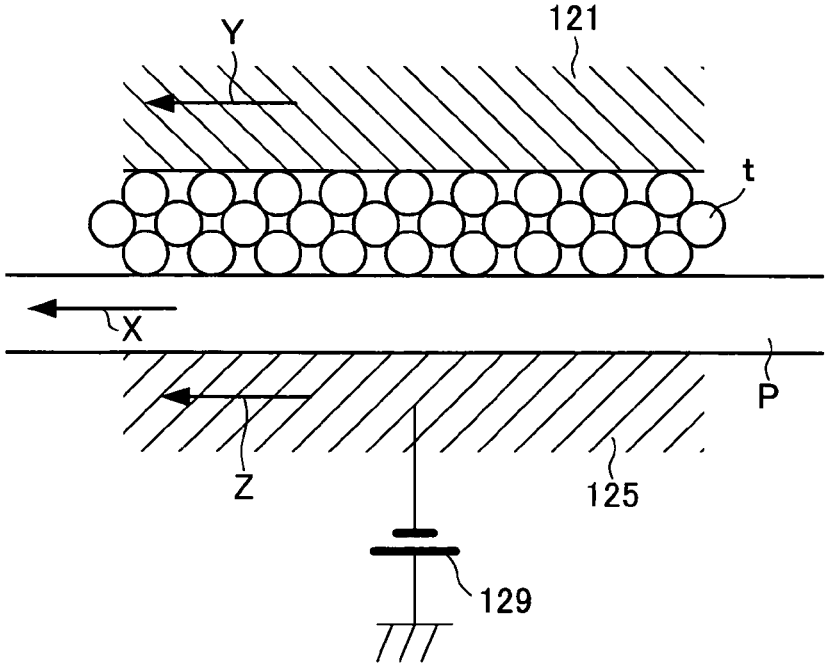
Figure 12:
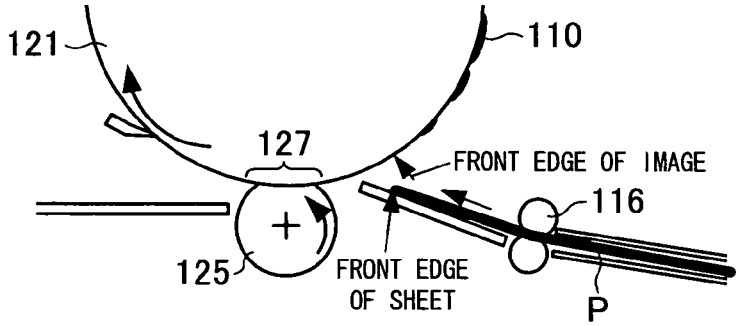
FIGS. 12(*a*) to 12(*d*) are explanatory diagrams showing how a sheet is conveyed to a transfer nip portion of a conventional image forming apparatus.
Figure 12:
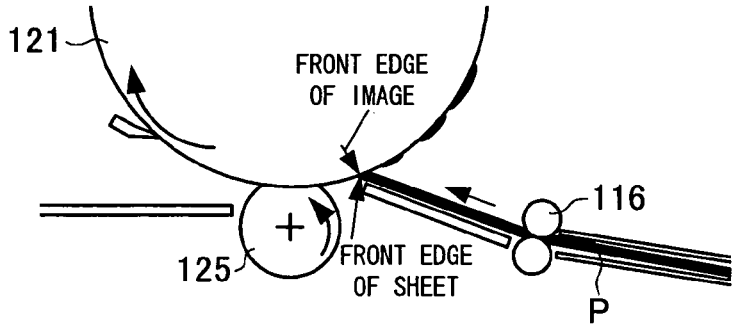
Figure 12:
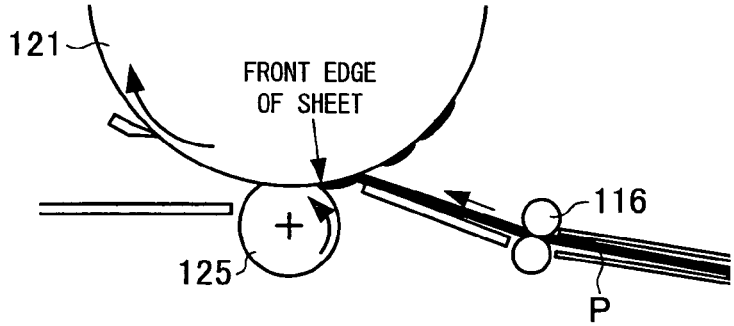
Figure 12:
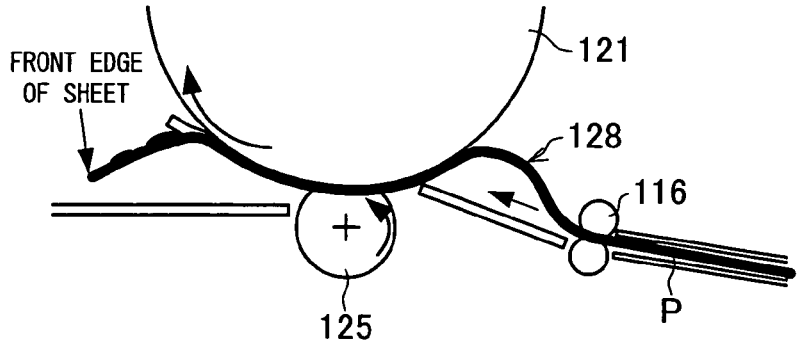

As shown in FIG. 10, in the print processing II, the idle roller 16 restarts driving to convey the sheet P to the transfer nip portion 27 (S11). When the sheet P is sandwiched by the transfer nip portion 27 (S12), the CPU 31 calculates the bending mount of the bended portion 28 on the basis of the difference between the peripheral velocity of the photoreceptor 21 and the peripheral velocity of the idle roller 16 (S13). During the conveyance of the sheet P, the CPU 31 judges whether or not the bending amount calculated is the amount which causes the slip phenomenon at the transfer nip portion 27 (S14). If the bending amount calculated is the amount which causes the slip phenomenon, the peripheral velocity of the idle roller 16 is controlled so that the bending amount calculated is adjusted to be the amount which does not cause the slip phenomenon (S15). Then, S13 to S16 are repeatedly carried out until the CPU 31 judges in S16 that the rear edge of the sheet P has finished passing through the idle roller 16. In this way, it is possible to adjust the bended portion 28 so that the bended portion 28 has a predetermined amount which does not cause the slip phenomenon.

Like the factor for predicting the occurrence of the image elongation, a reference value for judging in S14 that the bending amount is the amount which causes the slip phenomenon varies depending on the conditions (such as the thickness of the sheet P and the temperature and humidity in the image forming apparatus) which change the stiffness of the sheet P. Therefore, it is preferable that a plurality of reference values be prepared for appropriately carrying out the judgment in S14. Note that in the case of considering the apparatus internal environment information, it is ideal to prepare five types of reference values that are (i) a reference value for conditions of low temperature and low humidity, (ii) a reference value for conditions of low temperature and normal humidity and conditions of normal temperature and low humidity, (iii) a reference value for conditions of normal temperature and high humidity and conditions of high temperature and normal humidity, (iv) a reference value for conditions of high temperature and high humidity and (v) a reference value for conditions of low temperature and high humidity, conditions of normal temperature and normal humidity, and conditions of high temperature and low humidity.

As described above, in the present image forming apparatus, the occurrence of the phenomenon in which the image is lengthened on the sheet P by the slipping of the sheet P is predicted in advance. If the occurrence of the image elongation is predicted, the peripheral velocity of the idle roller 16 is controlled so that the bended portion 28 that is one factor for causing the image elongation and is formed in front of the transfer nip portion 27 is reduced in size. Therefore, it is possible to (i) suppress or prevent, without completely losing the bended portion 28 (without lowering the image quality), the occurrence of the slip phenomenon that is a factor for causing the image elongation, and reproduce an image that is substantially the same as the original, (ii) secure the rear edge void and (iii) appropriately avoid the above-described problems caused due to the reduction or disappearance of the rear edge void.

Note that the image elongation predicting section, the image elongation occurring area specifying section and the bending amount adjusting section in the image forming apparatus may be realized by a hardware logic or, as described in the present embodiment, a software using a CPU.

That is, the present image forming apparatus includes: a CPU (central processing unit) which executes a command of a control program for realizing functions of the image elongation predicting section, the image elongation occurring area specifying section and the bending amount adjusting section; a ROM (read only memory) which stores the program; a RAM (random access memory) which loads the program; a storage device (recording medium), such as a memory, which stores the program and various data; and the like. Then, the image forming apparatus can be realized by supplying a computer-readable recording medium to an image scanner apparatus and then causing its computer (CPU, MPU, or the like) to read out and execute a program code recorded in the recording medium. Note that the computer-readable recording medium records therein the program code (executable format program, intermediate code program, source program) of the control program which realizes the above-described functions. In this case, the program code itself read out from the recording medium realizes the above-described functions, and the recording medium recording the program code is included in the present invention.

Thus, in the present specification, section (means) does not necessarily mean a physical means, that is, the function(s) of each section (means) may be realized by software. Moreover, the function(s) of a single means may be realized by two physical means or more, and the functions of two means or more may be realized by a single physical means.

Note that in the present embodiment, the recording medium may be a memory (not shown) for process steps on a microcomputer. For example, the program medium may be something like a ROM. Alternatively, the program medium may be such that a program reader device (not shown) as an external storage device may be provided in which a storage medium is inserted for reading.

In any case, the stored program may be executable on access by a microprocessor. Further, the program may be retrieved, and the retrieved program may be downloaded to a program storage area (not shown) in a microcomputer to execute the program. The download program is stored in a main body device in advance.

The program medium may be a recording medium constructed separably from a main body. The medium may be (i) tape based, such as a magnetic tape or cassette tape, (ii) disc based, such as a magnetic disc (floppy disc, hard disk, etc.) and an optical disc (CD-ROM, MO, MD, DVD, etc.), (iii) card based, such as an IC card (including a memory card) and an optical card, (iv) or a semiconductor memory, such as a mask ROM, EPROM (Erasable Programmable Read Only Memory), EEPROM (Electrically Erasable Programmable Read Only Memory), and a flash ROM. All these types of media hold the program in a fixed manner.

Moreover, in the present embodiment, since the system is arranged to connect to the Internet or another communication network, the medium may be a storage medium which holds the program in a flowing manner so that the program can be downloaded over the communication network. Note that if the program is downloaded over a communication network in this manner, the download program may be stored in a main body device in advance or installed from another recording medium.

As above, an image forming apparatus of the present invention forms on an electrostatic latent image bearing member an electrostatic latent image based on image information, visualizes the electrostatic latent image by a developer so as to obtain a visible image, and causes a transfer device to transfer the visible image to a recording material at a transfer nip portion while conveying the recording material, and the image forming apparatus includes: a recording material conveying roller which is provided in front of the transfer nip portion and rotates intermittently so that the recording material and the visible image are aligned with each other; image elongation predicting means for predicting an occurrence of an image elongation, in other words, predicting that, due to slipping of the recording material with respect to the electrostatic latent image bearing member at the transfer nip portion, the visible image transferred is lengthened in a direction in which the recording material is conveyed; and bending amount adjusting means for, if the image elongation predicting means predicts that the image elongation occurs, variably controlling a peripheral velocity of the recording material conveying roller after a front edge of the recording material has reached the transfer nip portion, the peripheral velocity being variably controlled so that a bending of the recording material is reduced in size, the bending being formed between the transfer nip portion and the recording material conveying roller.

According to this, the image elongation predicting means predicts the occurrence of the image elongation, in other words, predicts that, due to the slipping of the recording material with respect to the electrostatic latent image bearing member at the transfer nip portion, the visible image transferred is lengthened in the direction in which the recording material is conveyed. If the image elongation predicting means predicts that the image elongation occurs, the bending amount adjusting means variably controls the peripheral velocity of the recording material conveying roller after the front edge of the recording material has reached the transfer nip portion, although the peripheral velocity of the recording material conveying roller is originally constant. Thus, the bending formed in front of the transfer nip portion is reduced in size.

That is, in the case in which the occurrence of a slip phenomenon is predicted, the bending of the recording material is reduced in size since the bending is one of factors for causing the slip phenomenon. This suppresses or prevents the occurrence of the slip phenomenon effectively. As a result, the blank space at the rear edge portion of the sheet is surely secured, and it is possible to appropriately avoid problems caused due to the reduction or disappearance of the blank space at the rear edge portion of the recording material. The problems are exemplified by (i) the printing stain caused by the remaining developer on the electrostatic latent image bearing member when printing an image on the following sheet(s), (ii) the deterioration in the printing quality (image quality) because of no blank space and (iii) the jam at the fixing section when carrying out the two-side printing adopting the switchback conveyance method.

In addition, in this case, the bending formed in front of the transfer nip portion does not completely disappear, but is just reduced in size so that the slip phenomenon does not occur. Therefore, it is possible to obtain an effect obtained by forming the bending, that is, an effect of avoiding a problem in which, before the recording material reaches the transfer nip portion, the recording material sticks to the transfer device so as to be charged unnecessarily.

It is appropriate that the image forming apparatus be configured such that the transfer device includes the transfer roller which is provided in such a manner as to be compressed against the electrostatic latent image bearing member via the recording material, and an electric field whose polarity is opposite to a polarity of an electric charge of the developer is applied to the transfer roller. Moreover, it is appropriate that $V1<V2\approx V3$, where V1 (mm/sec) is a peripheral velocity of the electrostatic latent image bearing member, V2 (mm/sec) is a peripheral velocity of the transfer roller and V3 (mm/sec) is a peripheral velocity of a recording material conveying roller provided in front of the transfer nip portion. Further, it is appropriate that $V1\times1.005\leqq V2\approx V3\leqq V1\times1.03$.

That is, the phenomenon of slipping of the recording material with respect to the electrostatic latent image bearing member easily occurs in the case in which the configuration of the transfer device, and the peripheral velocities of the electrostatic latent image bearing member, the transfer roller and the recording material conveying roller are as above. Therefore, in such a case, it is more effective to adopt the present invention. Further, it is appropriate that the present invention be applied to a case in which the average particle diameter of a developer to be used is equal to or less than 7 Φμm (the diameter of the large particle is less than 10 Φμm).

Further, the image forming apparatus of the present invention can be so arranged as to further include an image elongation occurring area specifying means for specifying an image elongation occurring area of the electrostatic latent image, the image elongation occurring area being an area having such a possibility that the image elongation occurs. In addition, in the image forming apparatus of the present invention, the bending amount adjusting means variably controls the peripheral velocity of the recording material conveying roller so that the bending is small when the image elongation occurring area specified by the image elongation occurring area specifying means has reached the transfer nip portion.

According to this, the bending having an appropriate amount is secured in front of the transfer nip portion while an area not having such a possibility that the slip phenomenon occurs is passing through the transfer nip portion, but the bending is reduced in size only while the area having such a possibility that the slip phenomenon occurs is passing through the transfer nip portion. Therefore, the bending which provides the above-described effect is not reduced in size while an area which does not require the reduction in size of the bending is passing through the transfer nip portion.

Moreover, the image forming apparatus of the present invention can be configured so that: as a factor for predicting the occurrence of the image elongation or as a factor for specifying the image elongation occurring area, the image elongation predicting means or the image elongation occurring area specifying means uses a printing ratio of a slip phenomenon occurring region of the recording material to which the visible image is transferred; and the slip phenomenon occurring region is a region which has such a possibility that a phenomenon of slipping of the recording material with respect to the electrostatic latent image bearing member occurs, and whose length in the direction in which the recording material is conveyed is determined depending on a length of the recording material in the direction in which the recording material is conveyed, and the length is 0 or more.

The occurrence of the image elongation and the image elongation occurring area relate to a printing ratio of the slip phenomenon occurring region of the recording material to which the visible image is transferred. Here, the slip phenomenon occurring region is a region which has such a possibility that a phenomenon of slipping of the recording material with respect to the electrostatic latent image bearing member occurs, and whose length in the direction in which the recording material is conveyed is determined depending on a length of the recording material in the direction in which the recording material is conveyed, and the length is 0 or more. In the case in which the length of the recording material is short, the slip phenomenon occurring region does not exist.

Therefore, by using the printing ratio of the slip phenomenon occurring region as a factor for predicting the occurrence of the image elongation or as a factor for specifying the image elongation occurring area, it is possible to accurately and appropriately predict the occurrence of the image elongation or specify the image elongation occurring area.

Specifically, the slip phenomenon occurring region can be (i) a region obtained by at least omitting from an entire region of the recording material, a certain region which is a region from a rear end of the recording material and which passes through the transfer nip portion in a state in which the recording material is not in the recording material conveying roller, the certain region being determined in accordance with a distance between the recording material conveying roller and the transfer nip portion, or (ii) a region obtained by at least omitting from an entire region of the recording material, a certain region which is a region from a front end of the recording material and which passes through the transfer nip portion in a period from a time point when a bended portion of the recording material starts formation in front of the transfer nip portion until a time point when the bended portion reaches a predetermined amount, the certain region being determined in accordance with the period.

Further, the image forming apparatus of the present invention can be configured so that as a factor for predicting the occurrence of the image elongation or as a factor for specifying the image elongation occurring area, the image elongation predicting means or the image elongation occurring area specifying means further uses at least one of a thickness of the recording material to which the visible image is transferred, a surface smoothness of the recording material to which the visible image is transferred and apparatus internal environment information including information of a humidity in the image forming apparatus.

The occurrence of the image elongation and the image elongation occurring area relate to the thickness of the recording material to which the visible image is transferred, the surface smoothness of the recording material to which the visible image is transferred, and the apparatus internal environment information including the information of the humidity in the image forming apparatus, respectively. Therefore, by using the thickness of the recording material, the surface smoothness of the recording material, and/or the apparatus internal environment information as a factor for predicting the occurrence of the image elongation and/or as a factor for specifying the image elongation occurring area, it is possible to accurately and appropriately predict the occurrence of the image elongation or specify the image elongation occurring area.

Further, the image forming apparatus of the present invention may be configured so that the bending amount adjusting means variably controls the peripheral velocity of the recording material conveying roller by using at least one of the thickness of the recording material, the length of the recording material and the apparatus internal environment information including the information of the humidity in the image forming apparatus.

As described above, the bending formed in front of the transfer nip portion is one factor for causing the slip phenomenon which causes the image elongation. The size (bending amount) of the bending which causes the slip phenomenon varies depending on the stiffness of the recording material. Therefore, by the bending amount adjusting means which adjusts the bending on the basis of the thickness of the recording material, the length of the recording material or the apparatus internal environment information, it is possible to effectively avoid the occurrence of the slip phenomenon and therefore the occurrence of the image elongation.

Further, the image forming apparatus of the present invention can be configured to variably control the peripheral velocity of the recording material conveying roller so that the bending formed between the transfer nip portion and the recording material conveying roller has a predetermined amount.

Thus, by controlling the peripheral velocity of the recording material conveying roller so that the size of the bending is kept to be the predetermined amount which does not cause the slip phenomenon, it is possible to effectively suppress the occurrence of the image elongation caused due to the slip phenomenon.

As above, a program for controlling the image forming apparatus of the present invention is a control program which causes a computer to execute the image elongation predicting means, the bending amount adjusting means and the image elongation occurring area specifying means. Therefore, it is possible to cause a computer to realize the image forming apparatus of the present invention (i) which can appropriately avoid the problems which cannot be avoided conventionally and is caused due to the reduction or disappearance of the blank space at the rear edge portion of the recording material and (ii) which can keep the effect of avoiding by the bending formed in front of the transfer nip portion the phenomenon in which the developer is reversely transferred. On this account, the image forming apparatus can be general-purpose.

As above, a recording medium of the present invention is a computer-readable recording medium recording the control program of the image forming apparatus of the present invention. Therefore, it is possible to easily supply to a computer the control program of the image forming apparatus of the present invention (i) which can appropriately avoid the problems which cannot be avoided conventionally and is caused due to the reduction or disappearance of the blank space at the rear edge portion of the recording material and (ii) which can keep the effect of avoiding by the bending formed in front of the transfer nip portion the phenomenon in which the developer is reversely transferred.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An image forming apparatus, comprising:

an electrostatic latent image bearing member on which an electrostatic latent image is formed based on image information;

a developer that visualizes the electrostatic latent image to obtain a visible image;

a transfer device that transfers the visible image to a recording material at a transfer nip portion while conveying the recording material;

a recording material conveying roller provided in front of the transfer nip portion and rotates intermittently so that the recording material and the visible image are aligned with each other;

image elongation predicting means for predicting an occurrence of an image elongation due to slipping of the recording material with respect to the electrostatic latent image bearing member at the transfer nip portion, the visible image transferred being lengthened in a direction in which the recording material is conveyed; and bending amount adjusting means for, if the image elongation predicting means predicts that the image elongation occurs, variably controlling a peripheral velocity of the recording material conveying roller after a front edge of the recording material has reached the transfer nip portion, the peripheral velocity being variably controlled so that a bending of the recording material is reduced in size, the bending being formed between the transfer nip portion and the recording material conveying roller.

2. The image forming apparatus as set forth in claim 1, wherein:

the transfer device includes a transfer roller compressed against the electrostatic latent image bearing member via the recording material; and an electric field whose polarity is opposite to a polarity of an electric charge of the developer is applied to the transfer roller.

3. The image forming apparatus as set forth in claim 2, wherein $$V1<V2=V3,$$

where V1 (mm/sec) is a peripheral velocity of the electrostatic latent image bearing member, V2 (mm/sec) is a peripheral velocity of the transfer roller, and V3 (mm/sec) is a peripheral velocity of the recording material conveying roller provided in front of the transfer nip portion, and V3 ranges from 0.99×V2 to 1.012×V2.

4. The image forming apparatus as set forth in claim 3, wherein $$V1\times1.005\leqq V2=V3<V1\times1.03.$$

5. The image forming apparatus as set forth in claim 1, further comprising:

image elongation occurring area specifying means for specifying an image elongation occurring area of the electrostatic latent image, the image elongation occurring area being an area having a possibility that the image elongation occurs, wherein said bending amount adjusting means variably controls the peripheral velocity of the recording material conveying roller so that the bending is reduced when the image elongation occurring area specified by said image elongation occurring area specifying means has reached the transfer nip portion.

6. The image forming apparatus as set forth in claim 1, wherein:

as a factor for predicting the occurrence of the image elongation or as a factor for specifying the image elongation occurring area, said image elongation predicting means or said image elongation occurring area specifying means uses a printing ratio of a slip phenomenon occurring region of the recording material to which the visible image is transferred; and the slip phenomenon occurring region is a region having a possibility that a phenomenon of slipping of the recording material with respect to the electrostatic latent image bearing member occurs, and whose length in the direction in which the recording material is conveyed is determined depending on a length of the recording material in the direction in which the recording material is conveyed, and the length of the region being 0 or more.

7. The image forming apparatus as set forth in claim 6, wherein the slip phenomenon occurring region is obtained by at least omitting from an entire region of the recording material, a certain region from a rear end of the recording material and which passes through the transfer nip portion in a state in which the rear end of the recording material is not in the recording material conveying roller, the certain region being determined in accordance with a distance between the recording material conveying roller and the transfer nip portion.

8. The image forming apparatus as set forth in claim 6, wherein the slip phenomenon occurring region is obtained by at least omitting from an entire region of the recording material, a certain region from a front end of the recording material and which passes through the transfer nip portion in a period from a time point when a bended portion of the recording material starts formation in front of the transfer nip portion until a time point when the bended portion reaches a predetermined amount, the certain region being determined in accordance with the period.

9. The image forming apparatus as set forth in claim 6, wherein, as the factor for predicting the occurrence of the image elongation or as the factor for specifying the image elongation occurring area, said image elongation predicting means or said image elongation occurring area specifying means further uses at least one of a thickness of the recording material to which the visible image is transferred, a surface smoothness of the recording material to which the visible image is transferred, and apparatus internal environment information including information of a humidity in the image forming apparatus.

10. The image forming apparatus as set forth in claim 1, wherein said bending amount adjusting means variably controls the peripheral velocity of the recording material conveying roller based on at least one of a thickness of the recording material, a length of the recording material, and apparatus internal environment information including information of a humidity in the image forming apparatus.

11. The image forming apparatus as set forth in claim 1, wherein said bending amount adjusting means variably controls the peripheral velocity of the recording material conveying roller so that the bending formed between the transfer nip portion and the recording material conveying roller has a certain amount.

* * * * *